United States Patent [19]

Del Monte

[11] Patent Number: 4,890,999

[45] Date of Patent: Jan. 2, 1990

[54] MOLDING MACHINE

[76] Inventor: Ernest J. Del Monte, 46 Harwood La., East Rochester, N.Y. 14445

[21] Appl. No.: 287,280

[22] Filed: Dec. 20, 1988

[51] Int. Cl.[4] ..... E04G 11/02; B28B 7/08

[52] U.S. Cl. ..... 425/439; 249/27; 249/63; 249/98; 249/137; 249/152; 249/180; 249/184; 249/194; 425/438

[58] Field of Search ..... 425/62, 63, 438, 439, 425/441; 249/27, 63, 98, 101, 102, 137, 152, 180, 184, 194

[56] References Cited

U.S. PATENT DOCUMENTS

| | | | |
|---|---|---|---|
| 2,903,177 | 9/1959 | Mitchell | 425/439 |
| 3,196,513 | 7/1965 | Parma | 425/439 |
| 3,853,452 | 12/1974 | Del Monte | 425/450.1 |
| 4,560,335 | 12/1985 | Cordova et al. | 425/62 |

*Primary Examiner*—James C. Housel
*Attorney, Agent, or Firm*—Samuel R. Genca

[57] ABSTRACT

A molding machine for casting a concrete product includes a stationary support system, a rotatable apparatus and a pair of bearings supporting the rotatable apparatus on the stationary support system. The rotatable apparatus rotates 180 degrees between an upward position and a downward position. The rotatable apparatus includes a mold having a configuration form, exterior wall-forming panel, interior wall-forming panels, and interior corner-forming panels, all of which hang from corresponding trolleys which ride on corresponding rails to form the walls of the concrete product when all of the panels are against the product's configuration form. Further included is a floor panel which cooperates with the interior wall-forming panels and the interior corner-forming panels and is supported thereon by an internal structure. The floor panel, the interior wall-forming panels, and interior corner-forming panels are positioned below the exterior wall-forming panels and spaced therefrom to contain the concrete therein. In order to reduce the curing time for the concrete in the mold, the molding machine includes a hoisting system and a transporter that cooperates in the unloading of the product from the mold. The hoisting system is fixed to the bottom of the rotatable apparatus. The transporter is pinned to exterior wall-forming panels by moveable pins that must be removed before the mold is moved into the discharge position to discharge the product from the mold. The pins also hold the transporter to the mold while the mold is being rotated between the upward and downward position.

13 Claims, 33 Drawing Sheets

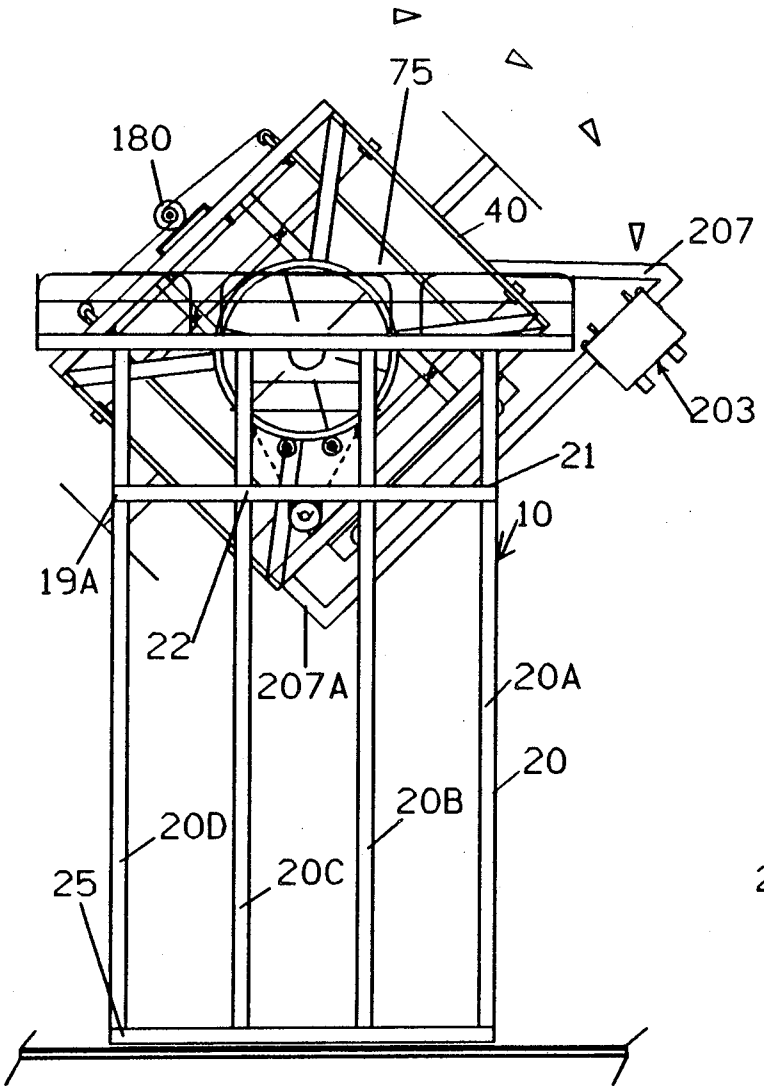
FIG. 21
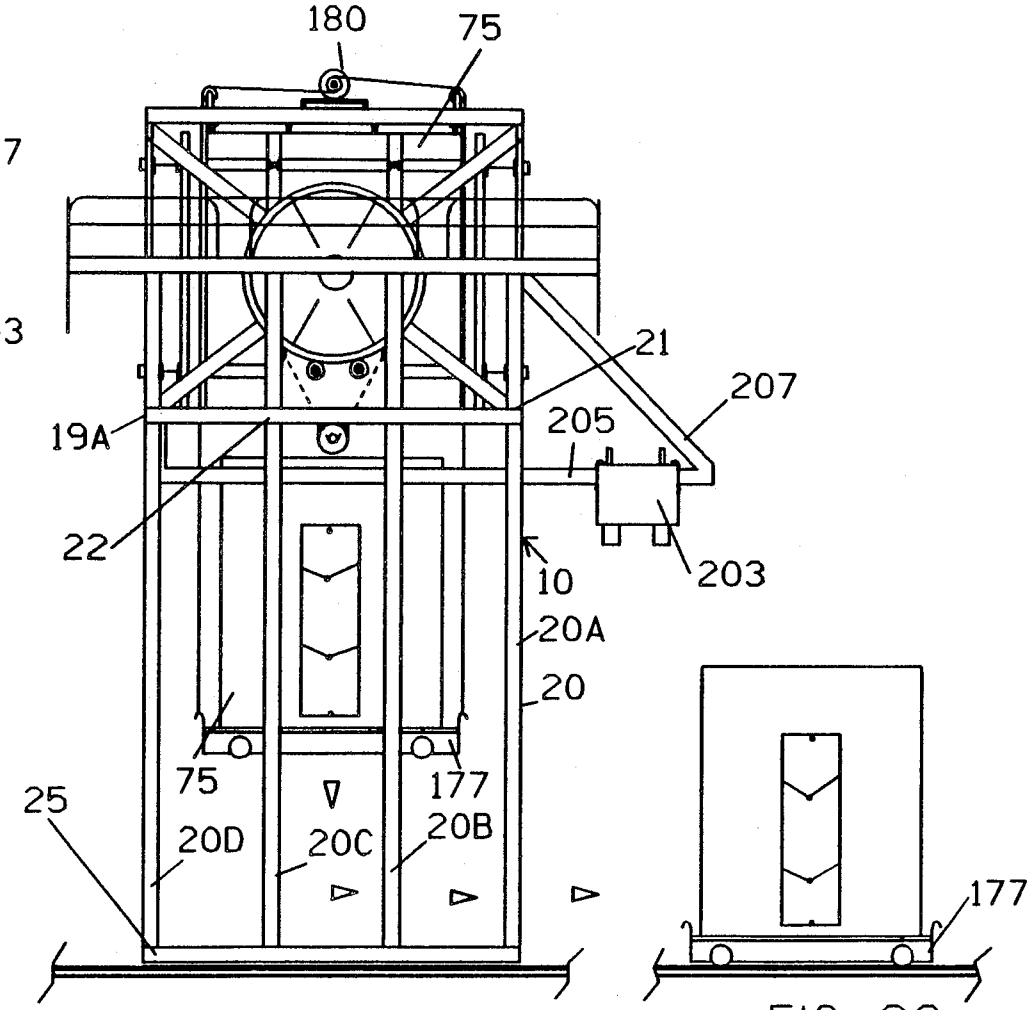
FIG. 22
FIG. 23

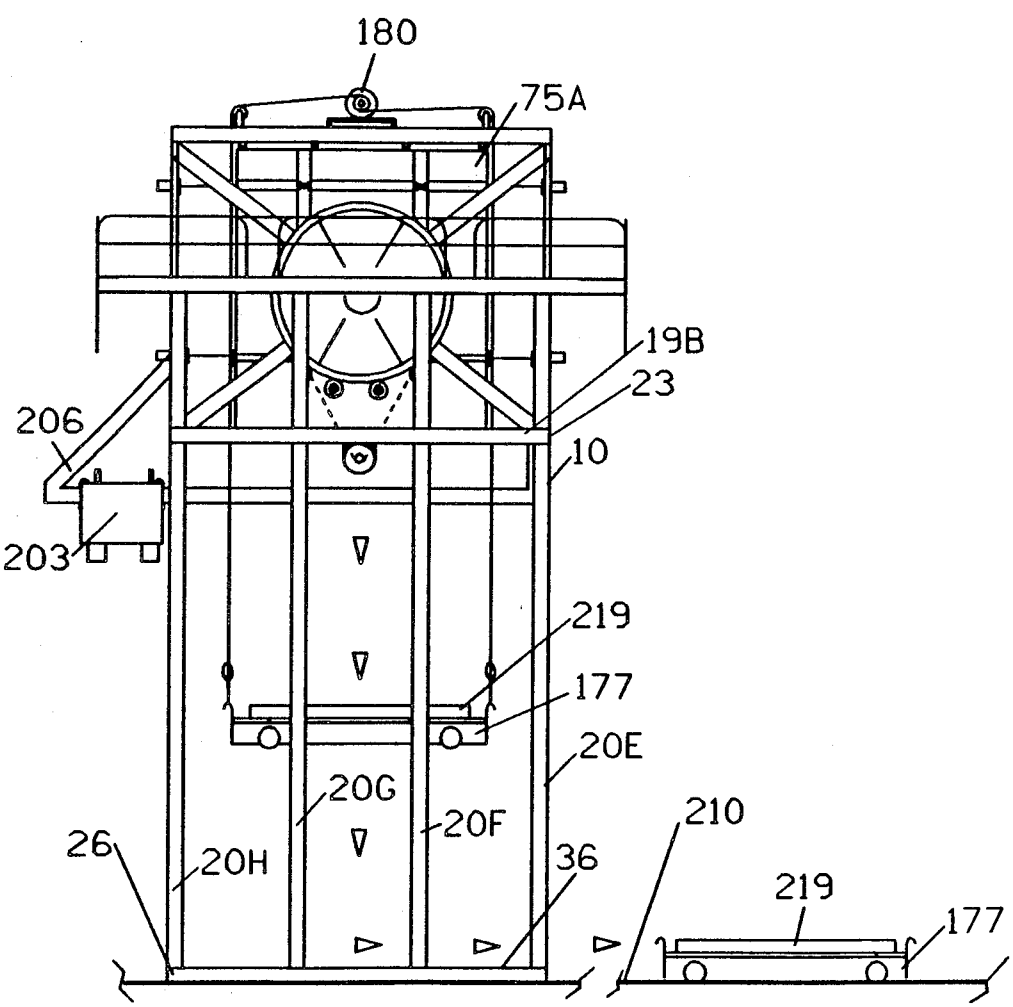
FIG. 31
FIG. 32
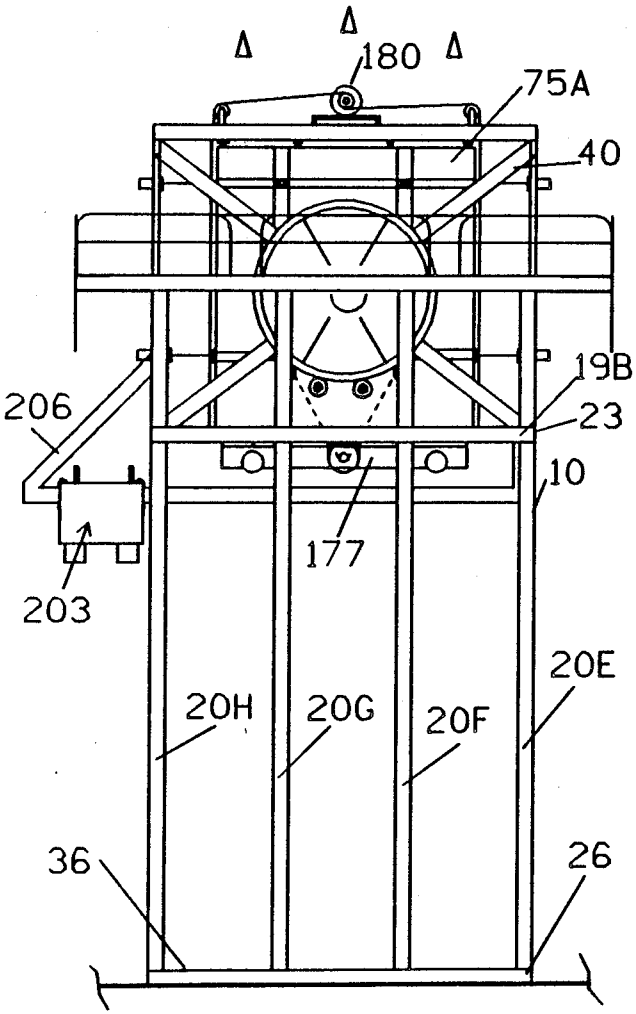
FIG. 30

MOLDING MACHINE

BACKGROUND OF THE INVENTION

1. FIELD OF THE INVENTION

The present invention relates to industrial mass-produced structural building modular unit or other similiar products such as a stackable room-module or other product from which a motel or hotel or apartment or hospital or nursing facility or extended care unit or housing or office building or the like, may be built, or more particularly to a novel molding machine and method of mass-producing such room modules or similiar products.

2. PRIOR ART

In my prior art molding machine described in my U.S. Pat. Number 3,853,452, there is disclosed a molding machine and method of industrial, mass-producing concrete building module units or modules with repetitive use and accuracy. In accordance with the prior art invention, the molding machine produces a modular unit with draft-free walls, square corners and an offset corners by featuring parallel-moving interior and exterior wall forming panels which are normal to a pre-cast concrete floor and interior corner panels which move along room diagonals into and out of molding positions. The interior and exterior wall-forming panels and corner panels are interlocked and spaced apart to form a cavity for pouring and setting concrete therein to form vertical, monolithic walls with the pre-cast floor. The parallel movable interior and exterior wall-forming panels and corner panels are suspended and movable on a frame having a super-structure which can be lifted above the formed monolithic concrete walls to release the molded concrete room modules from the molding machine.

Other attempts in the prior art for molding hollow concrete articles such as vaults employed complicated forms which were assembled for pouring of concrete between retaining walls. These forms were later disassembled after the formed concrete was set. While such prior art methods and apparatus were adequate for their intended purpose, they did not lend themselves for industrially, mass-produced modular units or modules, since it was difficult to reassemble the forms after each pouring and to repeat the same performance in a relatively short period of time.

Accordingly, there still exists a pressing need for a truly industrial means and method for mass-producing concrete products such as modular units or room modules for motels, hotels, apartments, hospitals, stores, offices, nursing and extended care facilities and houses, which means and method are efficient, accurate, easy to operate to produce a sound structural and architecturally artistic modular unit or room module and, more particularly, a concrete product such as a room room module having vertical walls and floor which are poured and casted simultaneously.

SUMMARY OF THE IVNENTION

Briefly described, a molding machine and method for producing a modular unit or product with draft-free walls, square corners, all of which are molded into a concrete product such as a modular unit or product, having a monolithic construction with walls and floor molded together. The molding machine comprises a stationary support system, a rotatable apparatus mounted on bearings on the stationary support system.

The rotatable apparatus includes a mold comprising exterior wall-forming panels, interior wall-forming panels and interior corner-forming panels spaced from the exterior wall panels, by a product's configuration form interposed between the exterior wall-forming panels, and the interior wall-forming panels and interior corner-forming panels and a floor panel being in cooperative relationship to and with the top of said interior wall-forming panels and the interior corner-forming panels. The floor panel is mounted above the interior wall-forming panel and interior corner-forming panels. The floor panel is spaced from the top of the exterior wall-forming panels by an amount equal to the floor thickness of the product, which product is to be cast in the mold, when the mold is in the casting position. The mold is rotated 180 degrees to discharge the product from the mold. The molding machine includes a hoisting system mounted on the rotatable apparatus, both for lifting a wire cage that is on a transporter or for lowering the concrete product from the mold to the transporter. The molding machine also includes a rotation system for rotating the rotatable aparatus to either the casting position or the discharge position. The hoisting system also locks the wire cage and transporter to the mold when the rotatable apparatus is rotated from the discharge position to the casting position, or from the casting position to the discharge position. The hoisting system also locks the transporter to the mold by moveable pins while the product is in the mold. The rotation system rotates the rotatable apparatus to the discharge position so that the hoisting system may lower the product with the transporter before the product is completely cured. In this manner, the product can continue to be cured outside the molding machine, thereby saving valuable curing time, while freeing the molding machine for the next casting. The molding machine includes a storage means for the transporter while the concrete is being poured into the mold to form the product.

DESCRIPTION OF THE DRAWINGS

The invention, and all its species, both as to its organization and method of operation, will best be understood by reference to the following description taken in connection with the accompanying drawings, in which:

FIG. 21 shows how the mold is rotated 180 degrees in preparation to release the product from the mold;

FIG. 22 shows the product being released from the molding machine of FIG. 1;

FIG. 23 shows the product carried by the transporter;

FIGS. 28, 29, 30, 31 and 32 illustrate the manner in which a new mold is placed in the molding machine;

DETAILED DESCRIPTION OF THE PREFERRED EMBODIMENT

Referring first to FIG's 1-16, FIG. 25 and FIG. 57 there are shown in pictorial representations a molding machine 10 in accordance with a preferred embodiment of the invention, which molding machine 10 is disclosed more fully hereinafter. Only those aspects of the molding machine 10 necessary for those skilled in the art to understand the various features of the invention have been shown.

Figures 57, 58:
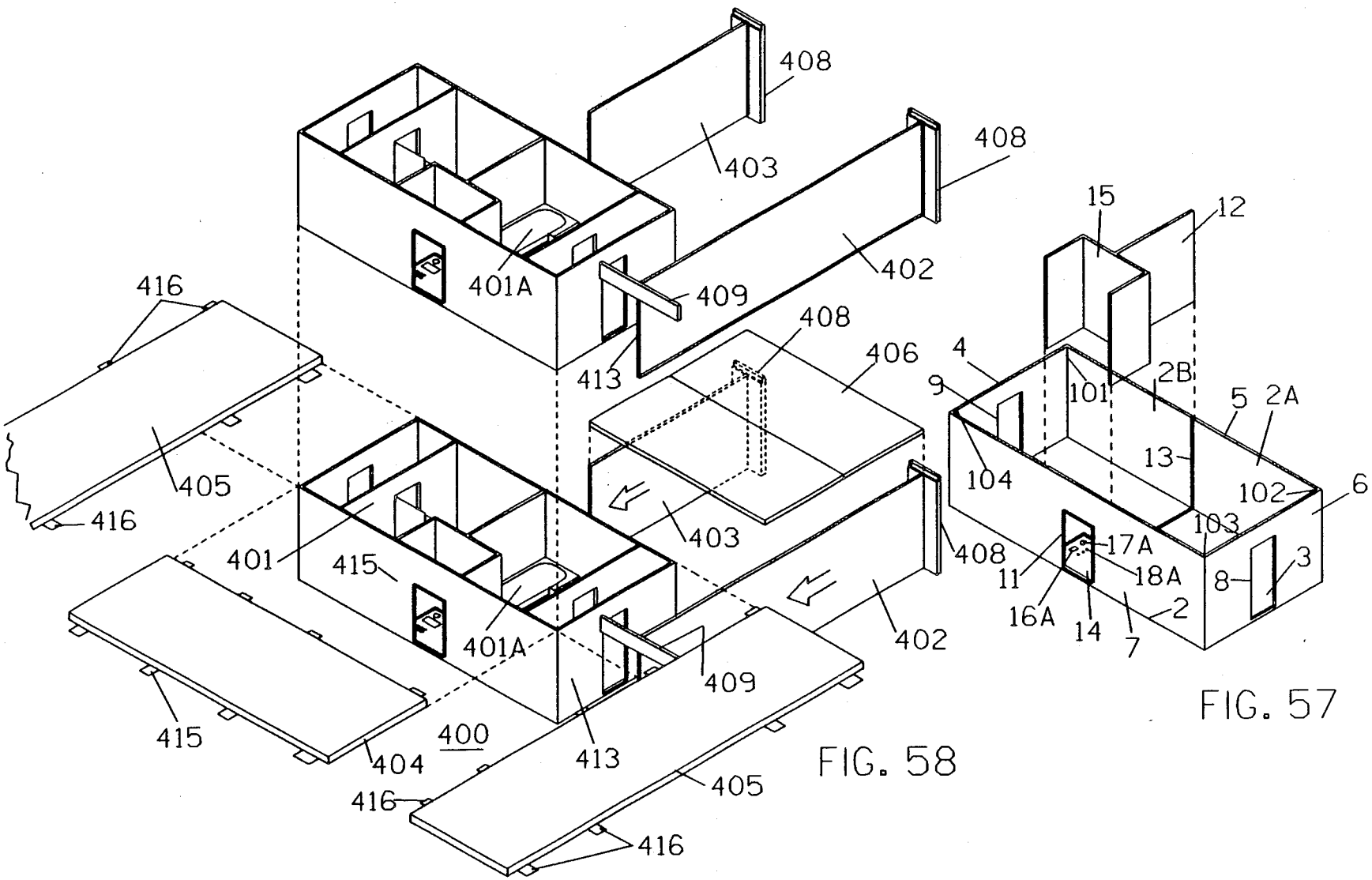
FIG. 57 illustrates a product formed by the molding machines of FIG. 1, ready to accept a modified "Y" shaped partition inserted into the product.
FIG. 58 shows a blown-up version of the lay-out of the products together with wall panels and ceiling panels to form a building structure.

Referring to FIG. 57, a product or room module 2 is shown comprising a floor 3, and vertical walls 4, 5, 6 and 7. It should be noted that the floor 3 and vertical walls 4, 5, 6 and 7 are molded or cast in concrete 1 simultaneously in the present invention. Whereas, in my prior invention disclosed in U.S. Pat. No. 3,853,452, the floor 3 was previously cast and then the four walls 4, 5, 6 and 7 were cast onto the precast floor 3. By casting the floor 3 and the vertical walls 4, 5, 6 and 7, we obtain a truly integrated cast room module which has strength that far exceeds room modules heretofore built. The room module 2 has side doorways 8 and 9 for entry into and out of the room module 2, and a doorway 11 to get into the chase area 14. A modified "Y" partition 12 is inserted at the center 13 of the room module 2 so as to divide the room module 2 into rooms 2A and 2B, with a chase area 14 at the interstice 15 of the modified "Y" partition 12. The chase area 14 includes a rectangular opening 16A, a circular opening 17A and round openings 18A, all cast in the floor 3 of the room module 2. This room module 2 and other room modules (not shown) having chase areas on the corner of those room modules (not shown) may be manufactured in accordance with the invention simply by changing the floor panels 137, 147 (FIG. 7) in a manner to be explained hereinafter.

Referring again to FIG.'s 1-16, and 25 the molding maching 10 is shown as comprising a stationary support system 20 including right-side stanchion 19A having paired columns 20A, paired columns 20B, paired columns 20C, paired columns 20D; and including left-hand stanchion 19B having paired columns 20E, paired columns 20F, paired columns 20G and paired columns 20H. Banding beam 21 connects paired columns 20A, 20B, 20C and 20D to each other at the upper end 22 of each said paired column, 20A, 20B,20C and 20D. Banding beam 23 connects paired columns 20E, 20F, 20G and 20H to each other at the upper end 24 of each paired column, 20E, 20F, 20G and 20H. At the lower end 35 of paired columns 20A, 20B, 20C and 20D, respectively, banding beam 25 is fastened thereto. At the lower end 36 of paired columns 20E, 20F, 20G and 20H, respectively, banding beam 26 is fastened thereto.

Figure 3:
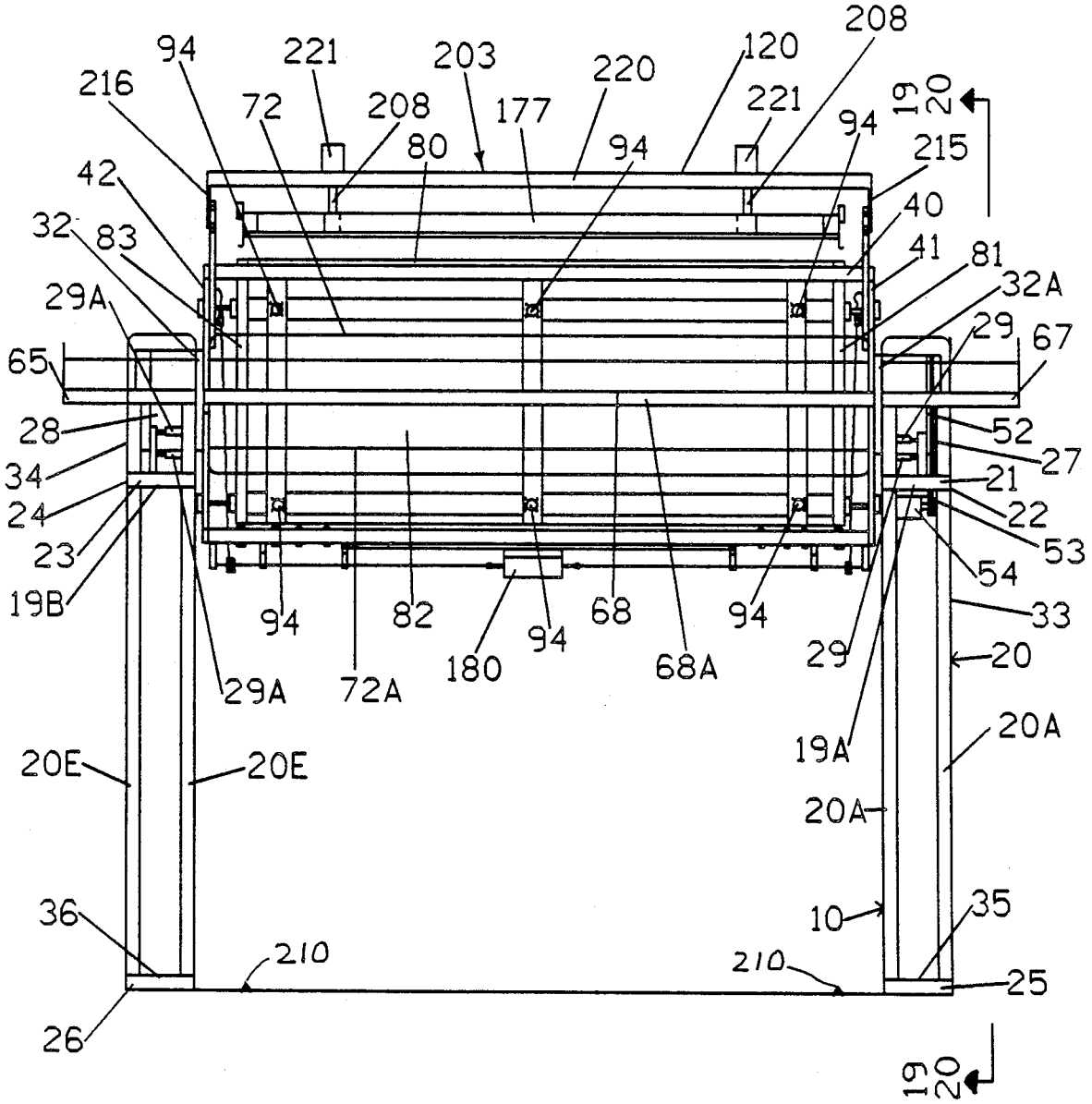
FIG. 3 is a front view of the molding machine shown in FIG. 1 and FIG. 2.
Figure 16:
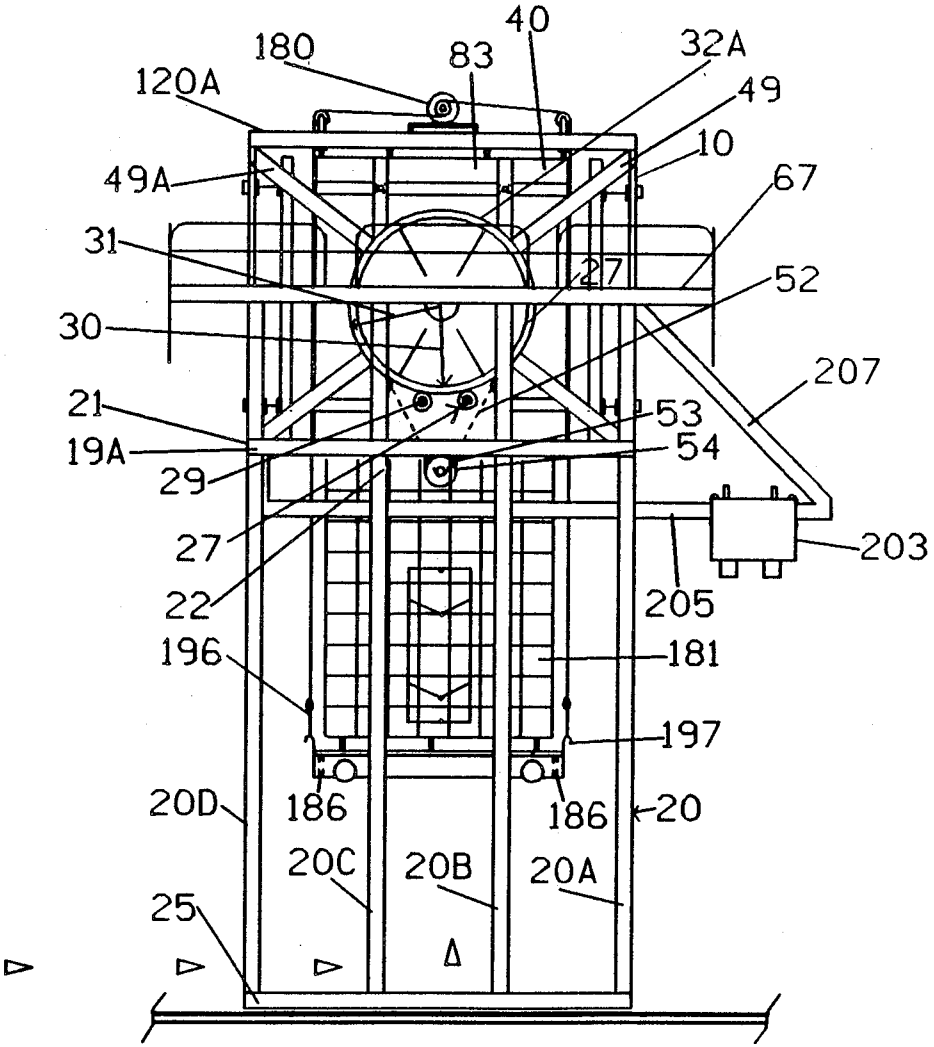
FIG. 16 shows a side view of the molding machine of FIG. 2, lifting the transporter and wire cage into the molding machine.
Figure 24:
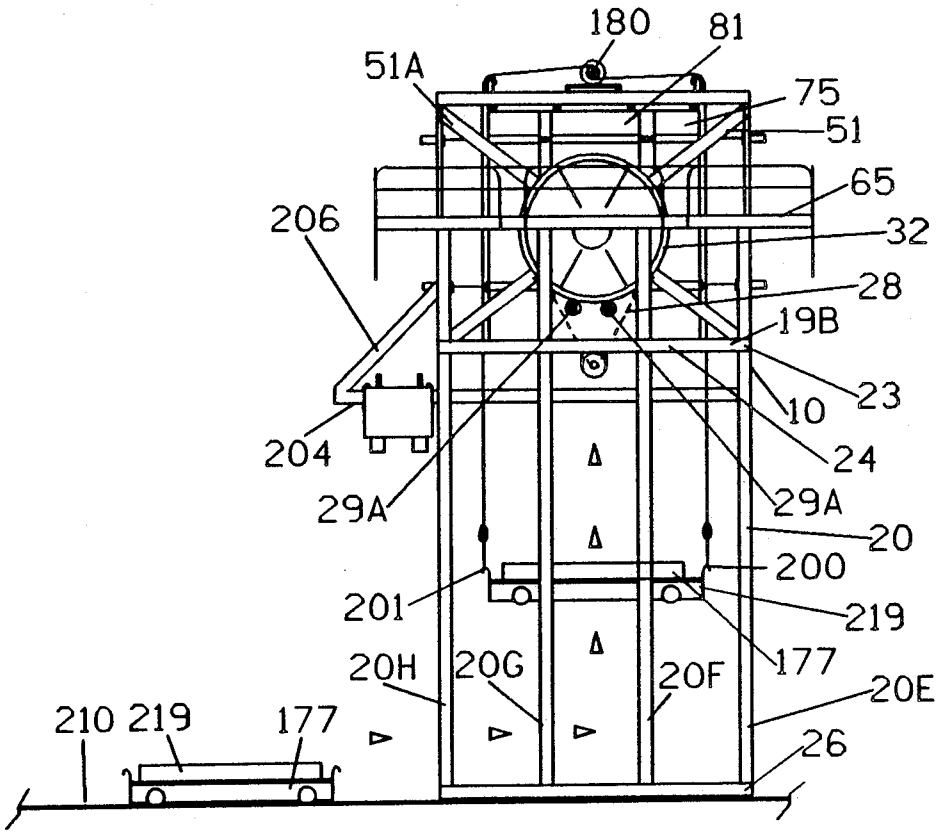

Located above paired columns 20B and 20C and between paried columns 20F and 20G are a pair of bearings, such as gudgeons 27 and 28, which include rollers 29 and 29A, respectively, disposed along a radii 30 which is substantially equal to the radii 31 of paired trunnions 32 and 32A (FIGS. 3, 16 and 24).

Figure 1:
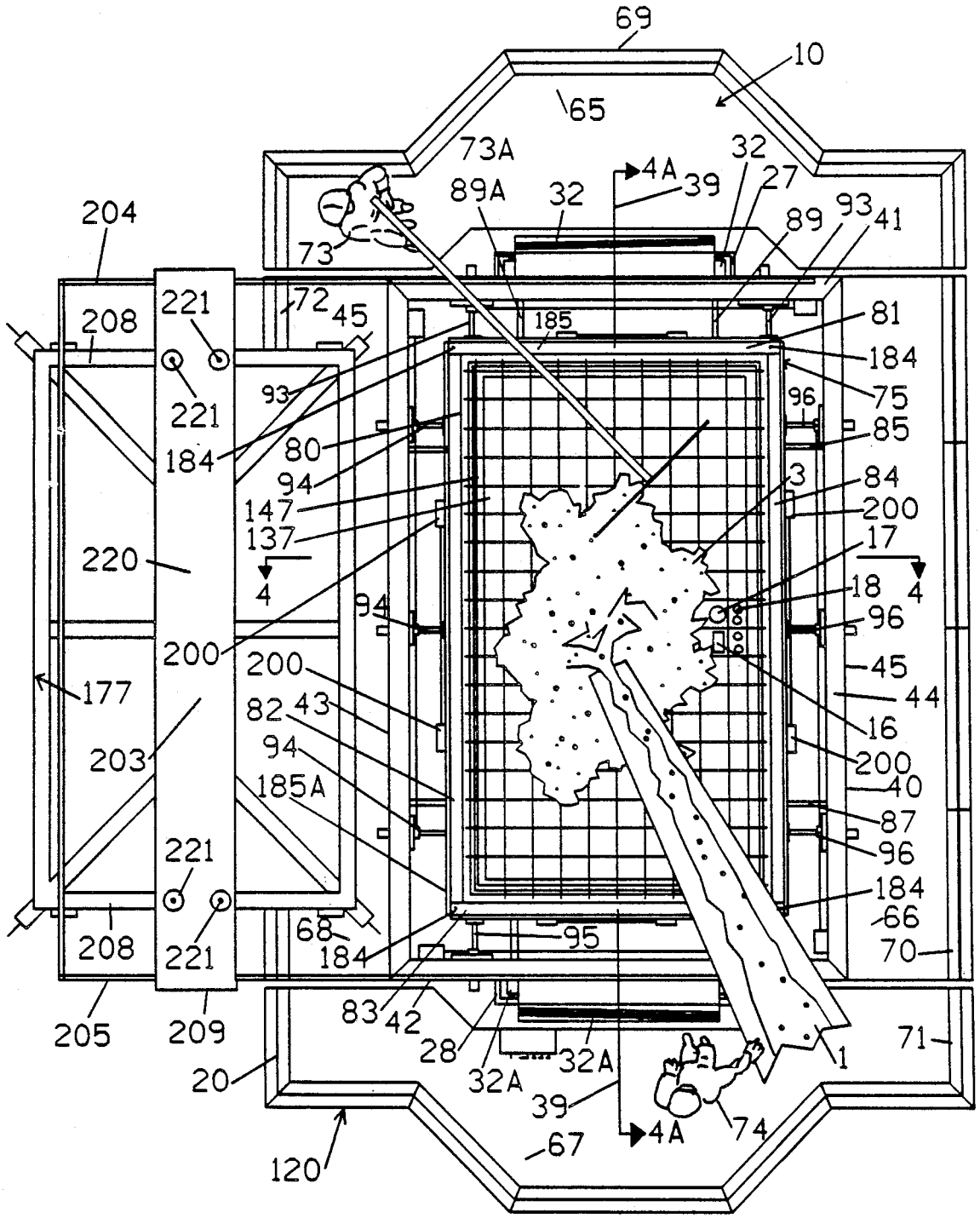
FIG. 1 is a plan top view of a molding machine made in accordance with a preferred embodiment of the invention showing the pouring of concrete into a mold to form walls and floor of a product that is inverted so that the product's floor is on the top.
Figure 2:
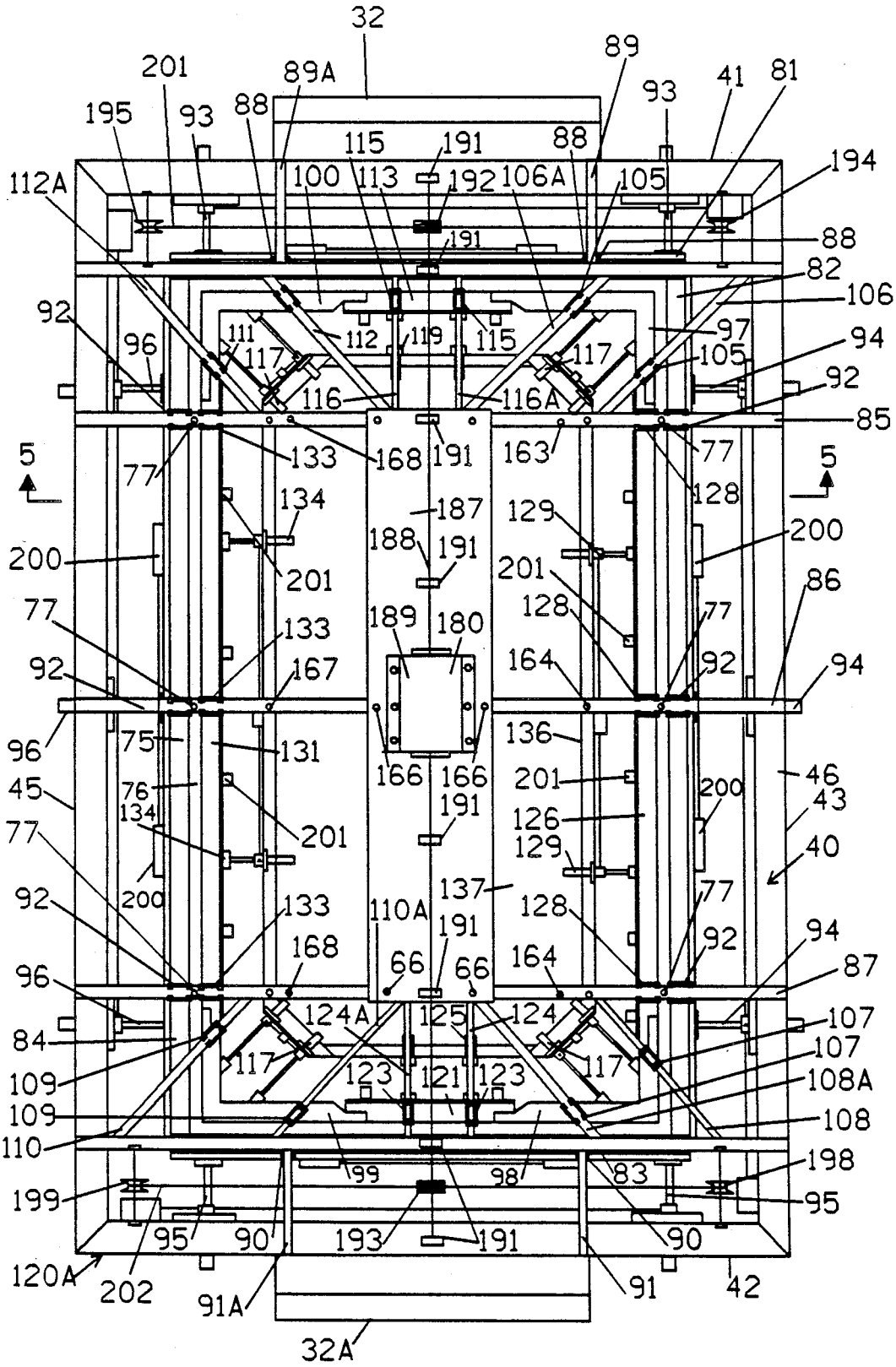
FIG. 2 is a partial bottom view of the molding machine shown in FIG. 1.
Figures 7, 8, 9, 10:
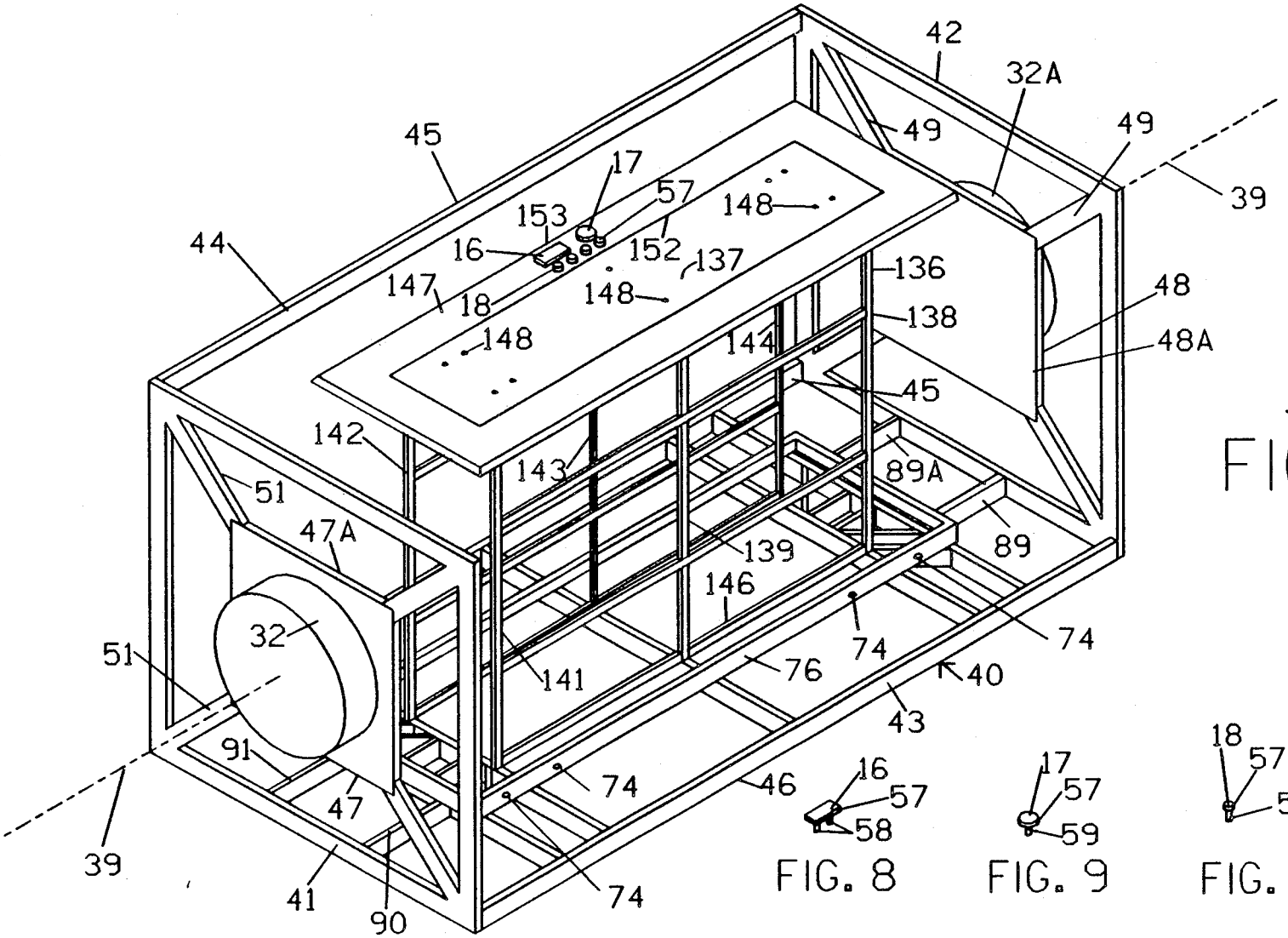
FIG. 7 shows a fragmentary view of the rotatable apparatus of the molding machine without the exterior wall-forming panels, interior wall-forming panels and interior corner-forming panels and other components thereof.
FIGS. 8, 9 and 10, respectively, show inserts of various designs which can be placed on the floor forming base as shown in FIG. 7.
Figure 14:
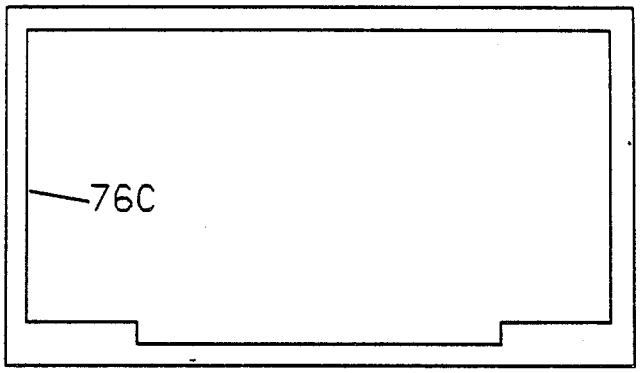
FIGS. 12, 13, and 14, respectively, are similiar to FIG. 11 and also show various product's configuration forms that may be used in the design of the molding machine shown in FIG. 1 and typically represent the top cross-sectional view of the product to be molded by the molding machine shown in FIG. 1.
Figure 13:
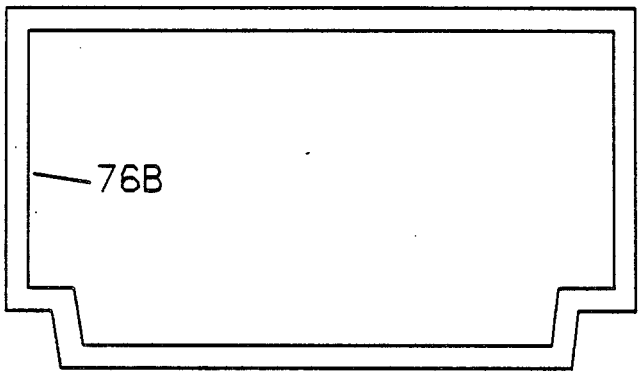
Figure 12:
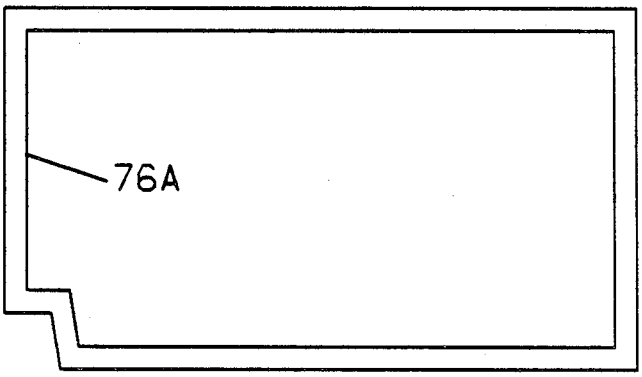

Trunnions 32 and 32A are fastened to the opposite sides 41 and 42 of the rotatable apparatus 40 as shown in FIGS. 1, 2 and 7. Thus, if we take an axis 39 through trunnions 32 and 32A and mate them to gudgeons 27 and 28 we find that the rotatable apparatus 40 rotates about this axis 39 (FIGS. 1 and 7).

The rotatable apparatus 40 is a space frame as shown in FIG. 7 and having sides 41, 42, 43, 44, 45 and 46. The rotatable apparatus 40 shows trunnions 32 and 32A being supported on plates 47, 47A, 48 and 48A, respectively, which are fixed to diagonal members 49 and 49A and to diagonal members 51 and 51A, respectively (FIG. 7).

Referring to FIGS. 3 and 16, rotatable apparatus 40 rotates in response to a rotation system 53 comprising a pulley cable 52 and a pulley drive 54 which is connected to the trunnion 32A by means of the pulley cable 52. The cable 52 drives the rotatable apparatus 40 between a casting position 120 and a discharge position 120A which are 180 degrees apart from each other. The rotatable apparatus 40 may stop in each of these positions, 120 and 120A, respectively, electronically or mechanically. FIG. 1 shows the molding machine 10 in the casting position 120 while FIGS. 2 and 16 show the molding machine 10 in the discharge position 120A.

Figure 11A:
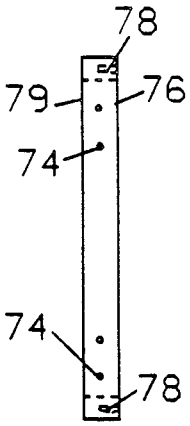
FIG. 11A is a side view of the product's configuration form of FIG. 11.
Figure 11:
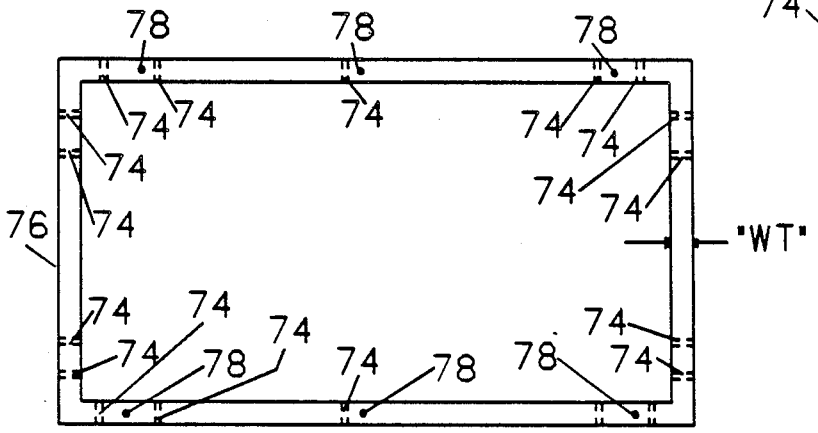
FIG. 11 shows a plan view of a product's configuration form.

A mold 75 is disposed within the space frame or rotatable apparatus 40. The mold 75 includes a product's configuration form 76 which defines the perimeter and wall thickness for a given product or room module 2 as may be seen in FIGS. 2 and 11. The product's configuration form 76 is of the same thickness as the product or the room module 2. The product's configuration form 76 is fixed to the rotatable apparatus 40 as shown in FIG. 7. The product's configuration form 76 is fixed to the rotatable apparatus 40 by bolts 77 and threaded screw-holes 78. The product's configuration form 76 may be removed with the mold 75 by unscrewing bolts 77 from the threaded screw-holds 78. The product's configuration form 77 clearly defines the product or room module 2, that is, the wall thickness is defined for a given product or room module 2, as the metes and bounds of the product or room module 2 are defined. Accordingly, therefore, the product's configuration form 76 establishes the product or room module dimension of 8.5 feet by 20.5 feet. It should be understood, however, that the room module dimension of 8.5 feet by 20.5 feet is by no means a controlling factor and other product configuration forms 76A, 76B and 76C may be used. The product's configuration form 76 is fixed at the bottom of the mold 75. The bottom of the mold 75 is also attached to the bottom of the rotatable apparatus 40.

The mold 75 comprises four (4) exterior wall-forming panels, 81, 82, 83 and 84, respectively. Wall-forming panel 81 is suspended by over-head trolleys 88 on rails or beams 89 and 89A, respectively. Wall-forming panel 83 is suspended by overhead trolleys 90 on rails or beams 91 and 91A, respectively. While exterior wall-forming panels 82 and 84 are suspended by overhead trolleys 92 on rails or cross-members 85, 86 and 87, respectively. Exterior wall-forming panels 81, 82, 83 and 84, respectively, are against the product's configuration form 76 when in the casting position 120 and are away from the product's configuration form 76 when in the discharge position 120A. In order for the exterior wall-forming panels 81, 82, 83 and 84, respectively, to move in and out of the casting position 120 and discharge position 120A, four electric JACTUATORS (reciprocating jack with an electrical control) 93, a registered trademark of DUFF-NORTON COMPANY, Charlotte, North Carolina, are provided for exterior wall-forming panel 81; and six electric JACTUATORS 94 are provided for exterior wall-forming panel 82; and four electric JACTUATORS 95 are provided for exterior wall-forming panel 83; and six electric JACTUATORS 96 are provided for exterior wall-forming panel 84. It should be understood that hydraulic or air cylinders may be used in place of the electric JACTUATORS 93, 94, 95 and 96.

The mold 75 further comprises four (4) interior corner-forming panels 97, 98, 99 and 100 for forming the interior corners 101, 102, 103 and 104 of the room module 2. Interior corner-forming panel 97 is suspended by overhead trolleys 105 on cross-members 106 and 106A on rotatable apparatus 40. Interior corner-forming panel 98 is suspended by overhead trolleys 107 on cross-members 108 and 108A on rotatable apparatus 40. Interior corner-forming panel 99 is suspended by overhead trolleys 109 on cross-members 110 and 110A on rotatable apparatus 40. Interior corner-forming panel 100 is suspended by overhead trolleys 111 on cross-members 112 and 112A which are part of rotatable apparatus 40. In order for the interior corner-forming panels 97, 98, 99 and 100, respectively, to move in and out of the casting position 120 and discharge position 120A, four electric JACTUATORS 117 are provided for each of the interior corner-forming panels 97, 98, 99 and 100.

The mold 75 further includes an end interior wall-forming panel 113 which together with interior corner-forming panels 97 and 100 form the end wall 4 of room module 2. End interior wall-forming panel 113 is suspended by overhead trolleys 115 on horizontal cross-members 116 and 116A on rotatable apparatus 40. In order for the end interior wall-forming panel 113 to move in and out of the casting position 120 and discharge position 120A, four electric JACTUATORS 119 are provided for end interior wall panel 113.

The mold 75 further includes an opposite end interior wall-forming panel 121 which together with interior corner-forming panels 98 and 99 form the opposite end wall 6 of room module 2. The opposite end interior wall-forming panel 121 is suspended by overhead trolleys 123 on horizontal rails or cross-members 124 and 124A on rotatable apparatus 40. In order for the opposite interior wall-forming panel 121 to move in and out of the casting position 120 and discharge position 120A, four electric JACTUATORS 125 are provided for back interior wall-forming panel 121.

The mold 75 further includes a side interior wall-forming panel 126 which together with interior corner-forming panels 97 and 98 form the side wall 5 of the room module 2. Side interior wall-forming panel 126 is suspended by three overhead trolleys 128 on horizontal rails or cross-members 85, 86 and 87 on rotatable apparatus frame 40. In order for the right interior wall-forming panel 126 to move in and out of the casting position 120 and discharge position 120A, four electric JACTUATORS 129 are provided for right interior wall-forming panel 126.

Figure 4C:
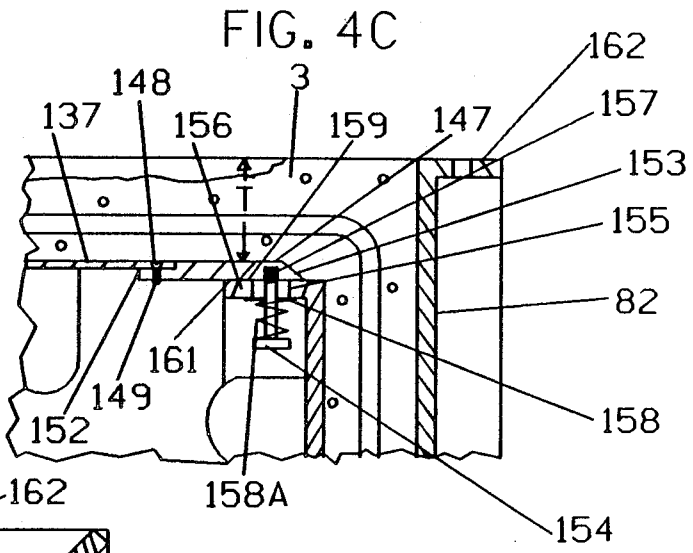
FIG. 4C shows a partial fragmentary sectional view enlarged to show details of how an interior wall-forming panel is moveable relative to a base member.
Figure 4:
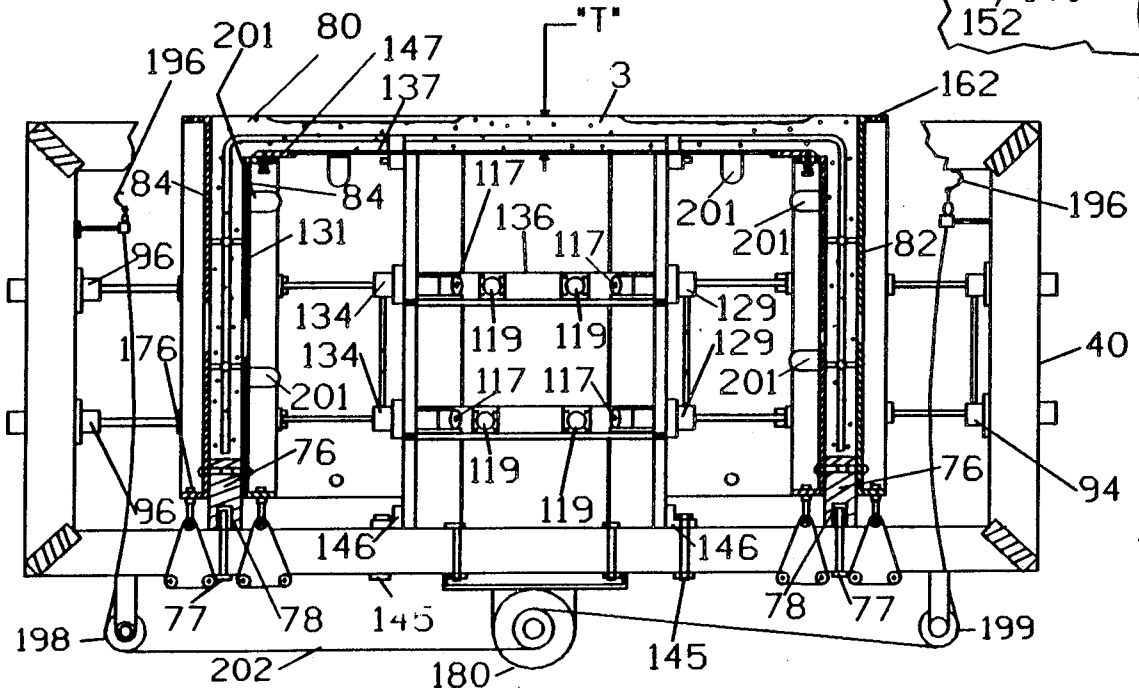
FIG. 4 shows a partial, fragmentary, cross-sectional view of the molding machine taken along line 4—4 of FIG. 1, with concrete poured in the cavity of the molding machine, while the molding machine is in the casting position.
Figure 5:
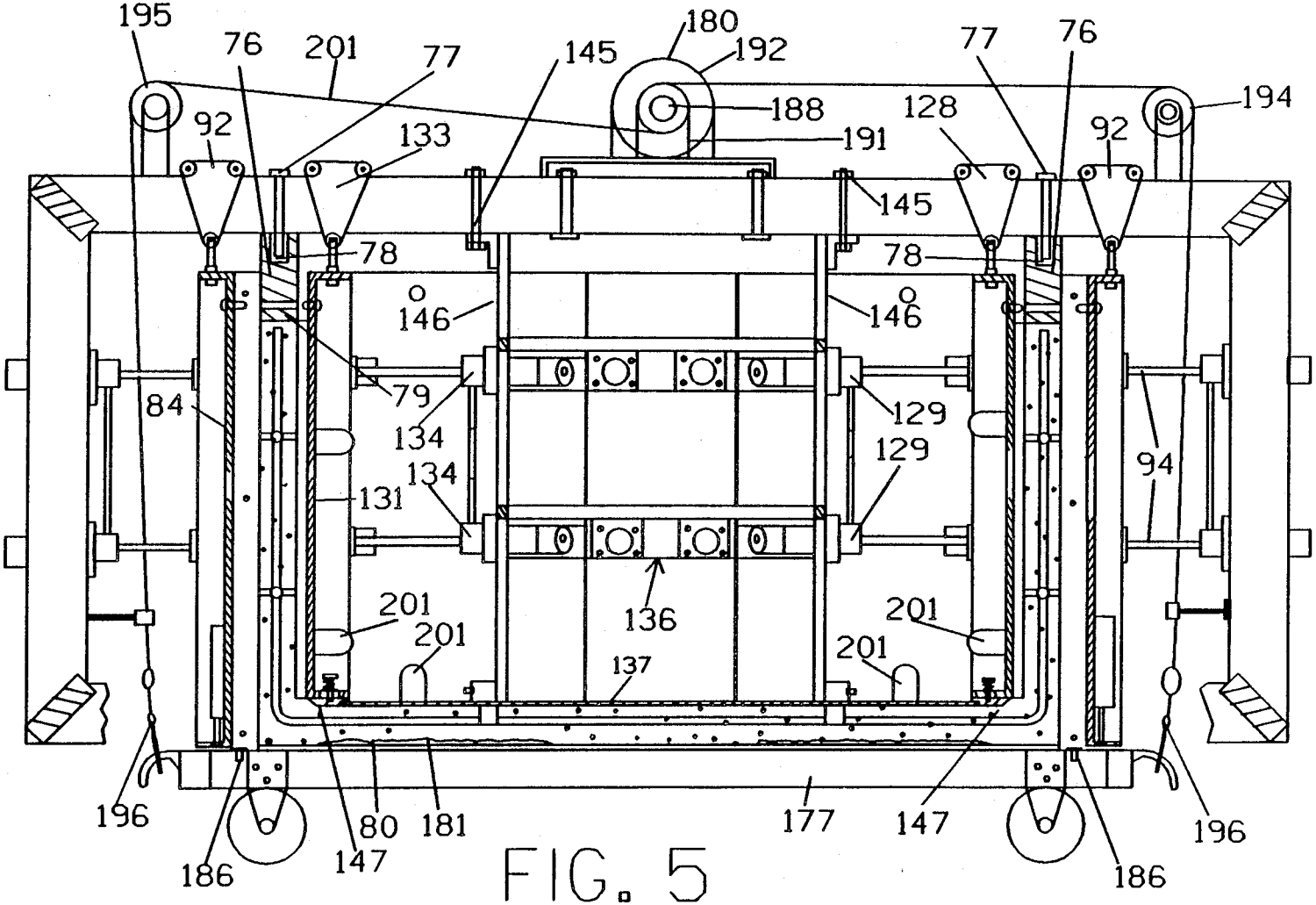
FIG. 5 shows a partial, fragmentary, cross-sectional view of the molding machine with a transporter supporting the product and the molding machine is in the discharge position and, by means of a hoisting system, the molding machine discharges the product.
Figure 6:
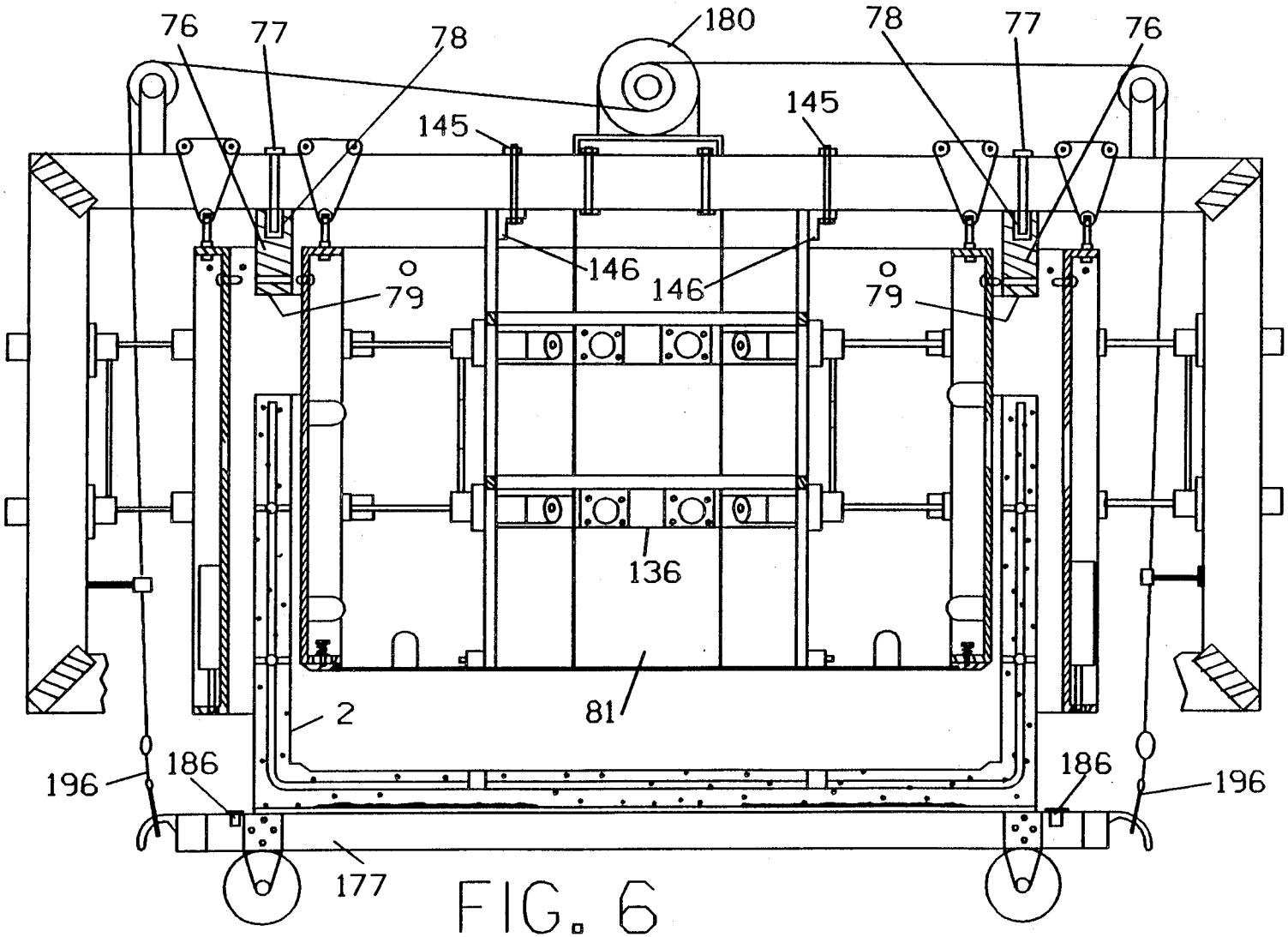
FIG. 6 shows the same view as FIG. 5, except that the product is being lowered by the transporter.

The mold 75 further includes an opposite side interior wall-forming panel 131 which together with interior corner-forming panels 99 and 100 form the opposite side wall 7 of room module 2. Opposite side interior wall-forming panel 131 is suspended by three overhead trolleys 133 on horizontal rails or cross-members 85, 86 and 87 on rotatable apparatus 40. In order for the opposite side interior wall-forming panel 131 to move in and out of the casting position 120 and discharge position 120A, four electric JACTUATORS 134 are provided for side interior wall-forming panel 131. The mold 75 further includes an internal structure 136 (FIGS. 2 and 7) which supports all of the thirtytwo internal JACTUATORS, namely, 117, 119, 125, 129 and 134. The internal structure 136 also supports the floor panel 137 on six columns, namely, 138, 139, 141, 142, 143 and 144. Referring to FIGS. 4, 5 and 6, the internal structure 136 (FIG. 4) is bolted on the inside by bolts 145 extending through angle irons 146 which are welded to the six columns, namely, 138, 139, 141, 142, 143 and 144, respectively.

The floor panel 137 (FIGS. 4 and 7) includes a base member 147 which is fixed to the floor panel 137 by counter-head screws 148 threaded into threaded holes 149 at one end 152 and at the other end 153 by a spring-loaded bolt 154 extending through an oblong clearance hole 155 located on flange 156 and threaded into a threaded hole 157 in base member 147. The oblong clearance hole 155 is approximately the size of the bolt 154, but is about five times the size of the bolt 154 in the other direction. A washer 158 is interposed between the flange 156 and the spring 158. The base member 147 is approximately twice the thickness of the floor 137 because there is wear between surface 159 and surface 161. The floor panel 137 is spaced from the top flange 162 of the exterior panel 82 by a distance "T" which, for example, may be five inches of concrete. The distance "T" is the thickness of the concrete floor 3 which may be seen in FIGS. 4, 4A and 57.

It may be seen that the floor panel 137 and base member 147 are integral units for casting the concrete floor 3 and floor panel 137 and base member 147 cooperate with all of the interior corner panels 97, 98, 99 and 100, and the internal panels 113, 121, 126 and 131, to cast the concrete floor 3 and the walls 4, 5, 6 and 7 with external panels 81, 82, 83 and 84. In accordance with the invention, the floor panel 137 and base member 147 are fixed to the internal structure 136, while all the interior corner panels 97, 98, 99 and 100 and internal panels 113, 121, 126 and 131 all move relative to each other and relative to the floor panel 137 and base member 147 at surfaces 159 and 161.

Figures 4A, 4B:
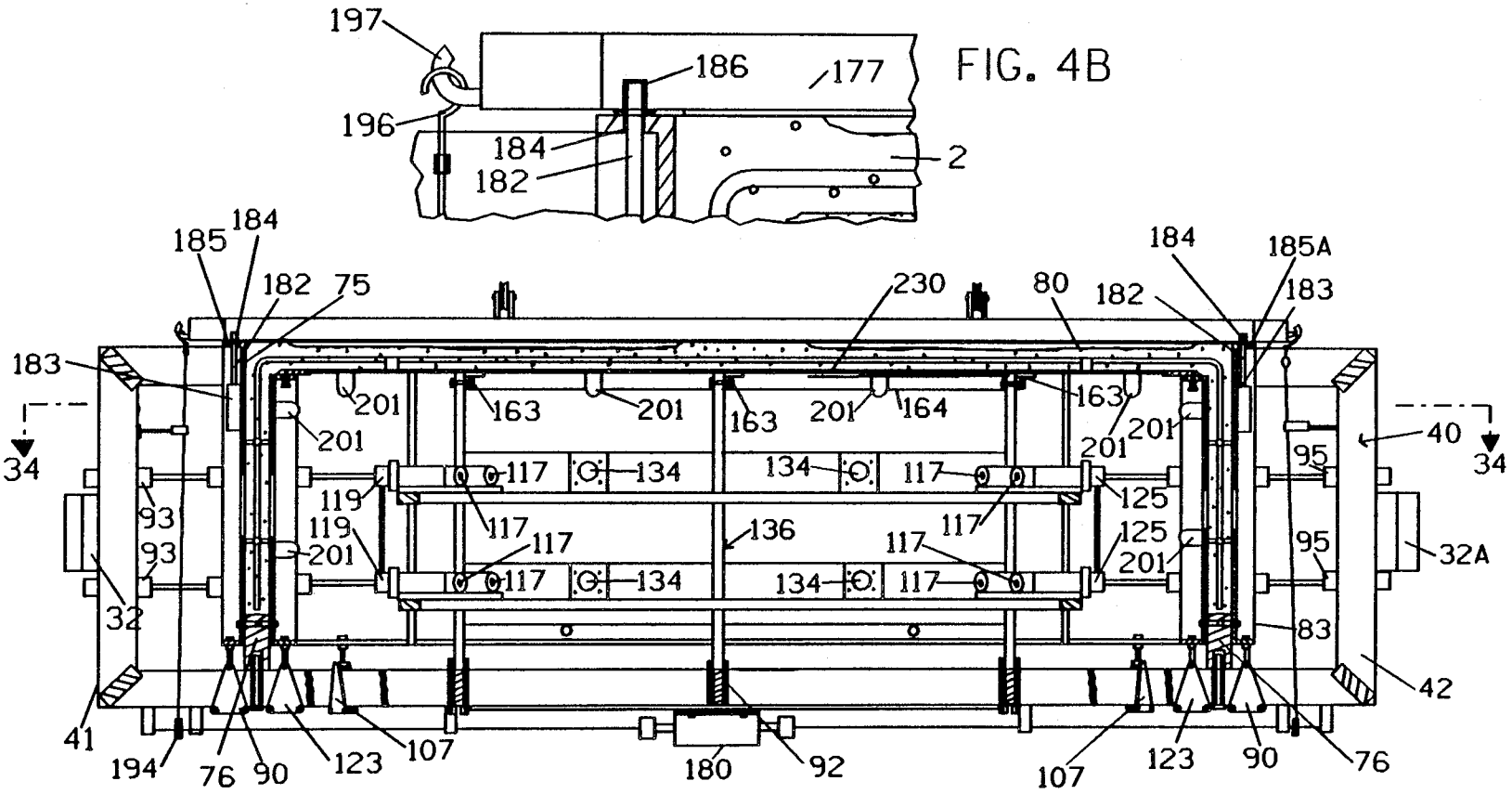
FIG. 4A shows another partial, fragmentary, cross-sectional view of the molding machine taken along line 4A—4A of FIG. 1, with concrete poured in the cavity of the molding machine.
FIG. 4B shows a partial enlargement of the molding machine and transporter with a piston pin inserted into a locating hole in the transporter.

Referring to FIGS. 8, 9 AND 10, there are shown a rectangular insert 16, a round insert 17, and a smaller round insert 18 that is smaller than the round insert 17. These inserts are used for providing openings 16A, 17A and 18A in the concrete floor of the room module 2. The insert 16 has a thickness 57, which thickness 57 is substantially equal to the thickness of the concrete floor 3 of the room module 2. The inserts 17 and 18 each also have the same thickness 57 as the floor 3. The insert 16 has two pins 58 which are used for fixing the insert 16 to the floor panel 137 or 147. Likewise, insert 17 has a pin 59 for insertion into floor panel 137 or 147; likewise, insert 18 has a pin 56 for insertion into floor forming base panel 137 or 147. Inserts 16, 17 and 18 are used for pipes, wires and other utility devices. The floor panel 137 is fixed to the internal structure 136 by bolts 163 going through angle members 164 (FIG. 4A).

The mold 75 is easily detachable from the rotatable apparatus 40 by removing bolts 77 and 145, and nuts 176 from all of the overhead trolleys 88, 90, 92, 105, 107, 109, 111, 115, 123, 128 and 133, and then lowering the mold 75 and the transporter 177 which is connected to the hoisting system 180 (FIGS. 2, 3, 4 and 5). This removal of mold 75 will be discussed hereinafter.

Figure 15:
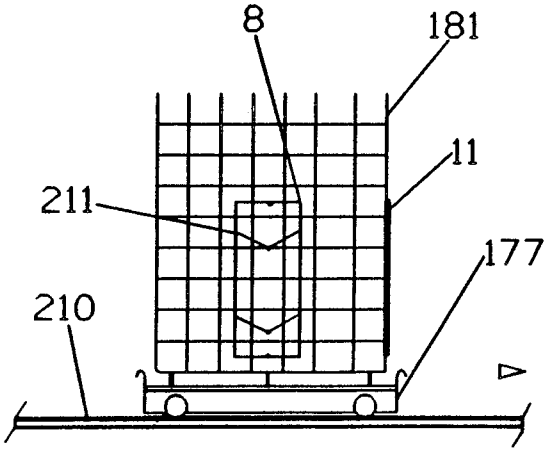
FIG. 15 shows a wire cage composed of reinforcment bars welded together so as to provide support for the room module when cast simultaneously therewith.
Figure 18:
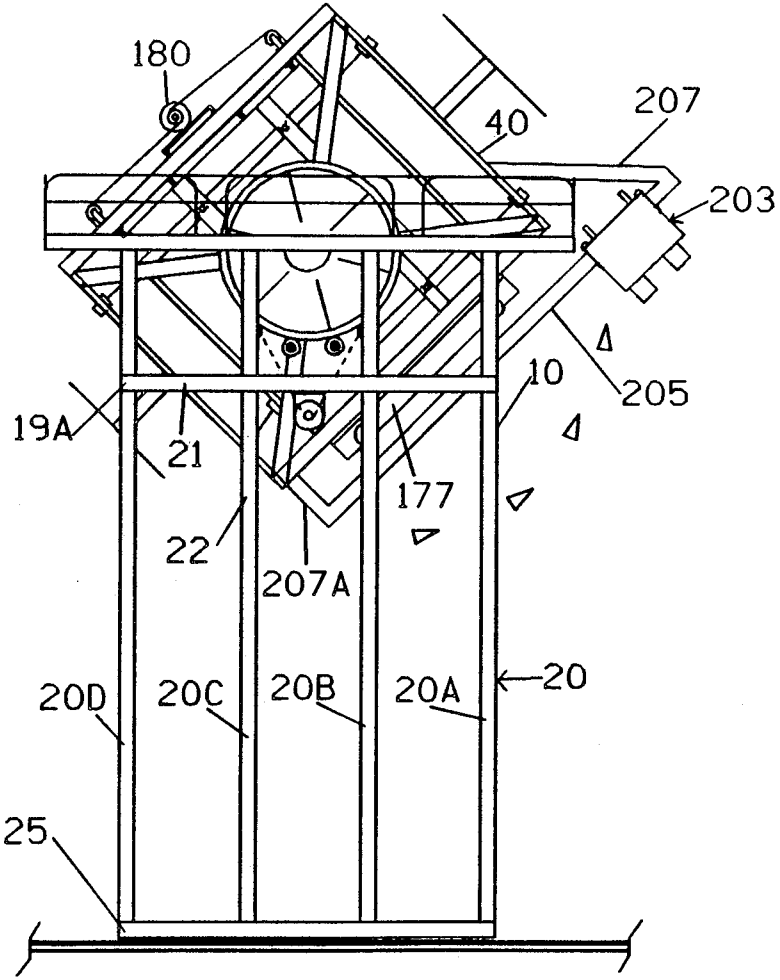
FIG. 18 shows the rotatable apparatus of the molding machine of FIGS. 1 and 2 being rotated 180 degrees into a casting position.
Figure 17:
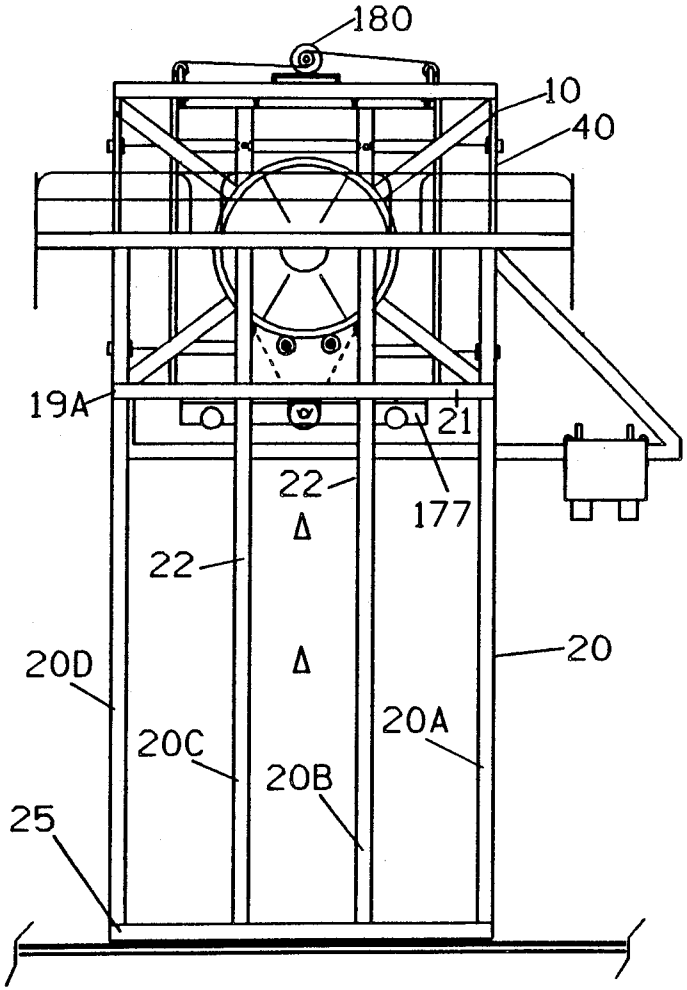
FIG. 17 shows another side view of the molding machine of FIG. 2 with the wire cage locked into the molding machine and the transporter locked onto the molding machine.

The molding machine 10 includes a hoisting system 180 for raising the transporter 177 and a reinforcing cage or an iron cage 181 into the mold 75 when the mold is disposed in the discharge position 120A (FIGS. 15 and 16). The hoisting system 180 locks the transporter 177 to the external panels 81 and 83 by engaging the piston pins 182 of air cylinders or hydraulic cylinders 183 into holes 184 located on the flanges 185 and 185A of exterior wall forming panels 81 and 83, and into locating bushings 186 of transporter 177, thereby locking the mold 75 and transporter 177 into position.

The hoisting system 180 is fastened on a plate 187 which is bolted to the cross-members 85, 86 and 87. The hoisting system 180 is on the reverse side of the bottom of the rotatable apparatus 40. The hoisting system includes two winches 192 and 193 that are at ends opposite to each other and the winches 192 and 193 are driven by a shaft 188 which extends from the motor-drive 189 and is supported on bearings 191. A cable 201 is connected to winch 192 and extends across pulleys 194 and 195 and terminates at two cart-hooks 196 on one side of the molding machine 10. On the other side of the molding machine 10, a cable 202 is fastened to the winch 193 and extends across pulleys 198 and 199 and terminates at two other cart-hooks 196.

Referring to FIGS. 1 and 3, the molding machine 10 includes a transporter means 203 for storing said transporter 177 when the mold 75 is in the casting position 120. The transporter means 203 comprises a pair of rails 204, 205 which are fixed to the rotatable apparatus 40 and are braced thereto by braces 206 and 207 and risers 206A and 207A. Riding on the pair of rails 204, 205 is a tram lifter 220 having four screw-jacks 221 which screw into the bottom frame 208 of the transporter 177. The screw-jacks 221 raise and lower the transporter 177 over the mold 75 as well as transport the transporter 177 to the storage position 209 as shown in FIG. 1, that is, the transporter 177 is shown clearly away from the mold 75.

For a matter of safety, around the molding machine 10 are platforms 65, 66, 66A, 67, 68 and 68A and railings 69, 70, 70A, 71, 72 and 72A. The railings 69, 70, 70A, 71, 72 and 72A are in place to protect workers 73 and 74. The worker 73 has a spreader 73A that he is using.

In the operation of the molding machine 10 a wire cage 181 is transported over rails 210 (FIG. 15). The wire cage 181 is equipped with special door fixtures 211 which have the same thickness of the door 8 and walls 4, 5, 6 and 7. In FIG. 16, the wire cage 181 and the transporter 177 are placed beneath the mold 75 in the molding machine 10. The four cart-hooks 196 are placed over pick-up hooks 197 of the transporter 177. The hoisting system 180 raises the transporter 177 and wire cage 181 into the mold 75. The rotatable apparatus 40, the mold 75, the wire cage 181 and the transporter 177 are then clamped together by the hoisting system 180. The alignment is accomplished by the air cylinders 183 together with the piston pins 182 which fit into the holes 184 in the transporter 177. The transporter 177, mold 75 and rotatable apparatus 40 are rotated by the cable 52 driven by the pulley motor 54 which in turn rotates the trunnion 32A and the rotatable apparatus 40.

Figure 19:
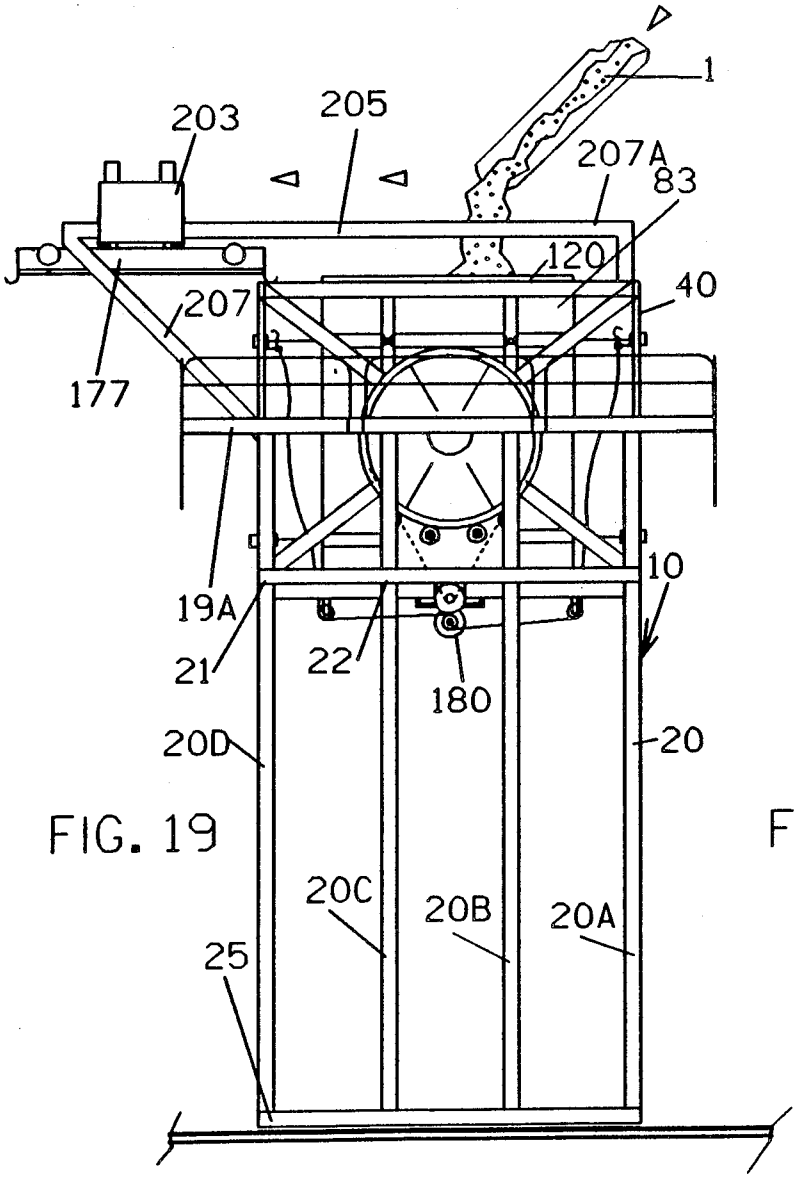
FIG. 19 illustrates, as in FIG. 1, how the transporter has been removed from the molding machine and then how concrete is poured into the molding machine that forms the floor and walls of the product.

The rotatable apparatus 40 rotates until it is disposed in the casting position 120 and ready to accept concrete 1 into the mold 75. For that purpose the tramm lifter 220 picks up the transporter 177 and transports the transporter 177 to a storage position 209 as shown in FIG. 19. The concrete 1 is poured into mold 75 until the mold 75 is filled up. During this time when the concrete 1 is being poured, the external vibrators 200 and the internal vibrators 201 are turned on and, when the internal vibrators 201 are turned on, cause the concrete 1 to flow into the cavity 80 between the exterior wall-forming panels 81, 82, 83 and 84 and the internal corner-forming panels 97, 98, 99 and 100, together with the internal wall panels 113, 121, 126 and 131 and together with the floor panel 137. The concrete 1 which forms the room module 2 is allowed to cure in the mold 75 until it achieves a concrete strength to support itself without the mold 75.

Figure 20:
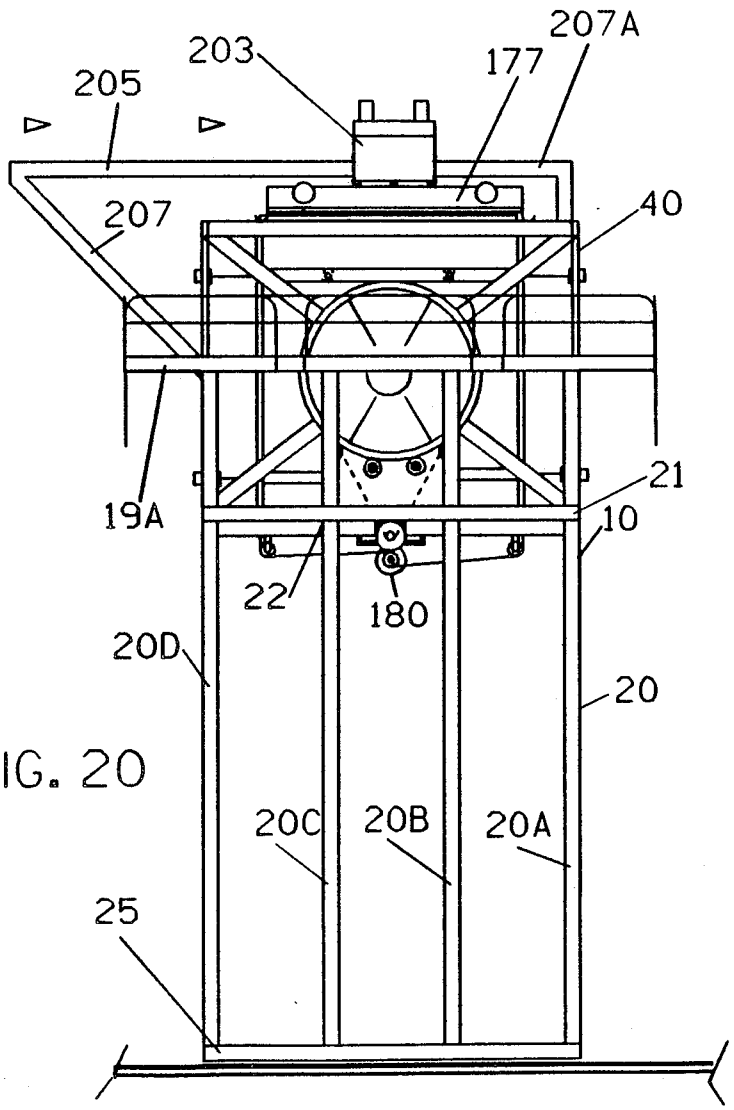
FIG. 20 illustrates how the product is cured in the mold and then the transporter is moved over the product and locked onto the molding machine.

Referring now to FIG. 20, when the room module 2 is partially cured, then the transporter 177 is placed over the room module 2 and the mold 75. The hoisting system 180 locks the transporter 177 to the room module 2 and mold 75 by placing the carthooks 196 over the transporter pick-up hooks 197. The motor 189 when in the "On" position keeps the drive pressure on the transporter pick-up hooks 197. The piston pins 182 of the air cylinders 181 fill the holes 184 on the flanges 185 and 185A. The mold 75 and the rotatable apparatus 40 are now ready to rotate about the axis 39 from the casting position 120 to the discharge position 120A.

Referring now to FIG. 21, the rotatable apparatus 40, the mold 75 and the room module 2 within the mold 75, are shown in rotation from the casting position 120 to the discharge position 120A.

FIG. 22 shows that the rotatable apparatus 40 and mold 75 are shown in the discharge position 120A. The piston pins 182 are withdrawn from the locating bushings 186 of the transporter 177. All of the exterior wall-forming panels 81, 82, 83, 84 and the interior wall-forming panels 113, 121, 126, and 131 and the interior corner-forming panels 97, 98, 99 and 100 are now being retracted from the product's configuration form, viz, the discharge position 120A. The room module 2 is now lowered on the transporter 177 to the rails 210

FIG. 23 shows the room module 2 being transported on a transporter 177 on rails 210 wherein various operations are made on the room module 2 in preparation for installation of room module 2 in a hotel room or other building structure.

Referring now to FIGS. 24 through 33, the sequence for removing the mold 75 from the molding machine 10 and replacing the mold 75 with a new mold 75A will be shown. Referring now to FIG. 24, the transporter 177, with a mold holder 219 on the transporter 177, is lifted by the hoisting system 180 up to the mold 75.

Figure 25:
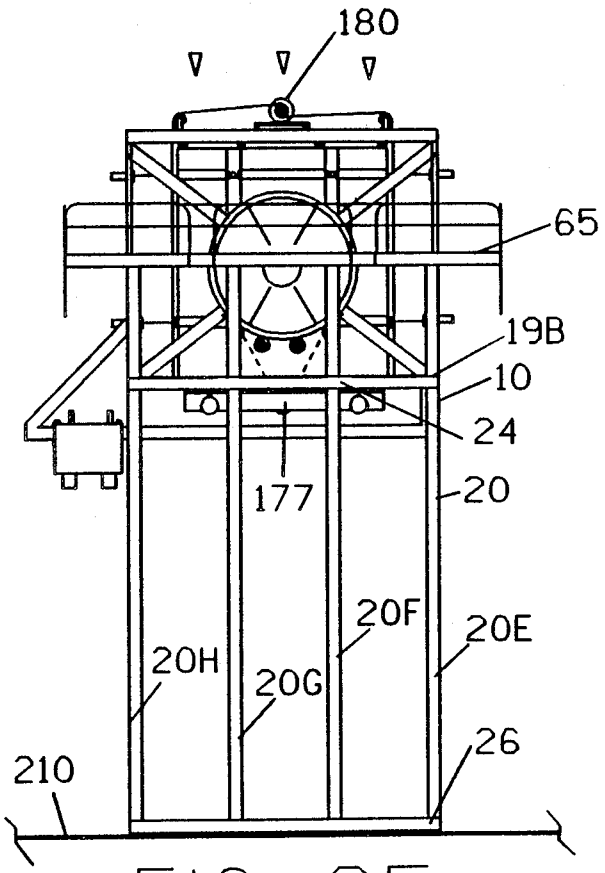
FIGS. 24, 25, 26 and 27 illustrate the mold and the molding machine that contains it and the manner in which the mold is removed from the molding machine.

Referring now to FIG. 25, the hoisting system 180 lifts the transporter 177 with the mold holder 219. The mold holder 219 is inserted into the mold while the transporter 177 is urged against the mold 75 by the hoisting system 180. The mold 75 is easily detachable from the rotatable apparatus 40 by removing bolts 77 and 145, and nuts 176 from all the overhead trolleys 88, 90, 92, 105, 107, 109, 111, 115, 125, 128 and 133. All the JACTUATORS 93, 94, 95 and 96 which operate the external wall panels 81, 82, 83 and 84 must be detached before lowering the mold 75 on the transporter 177.

Figure 27:
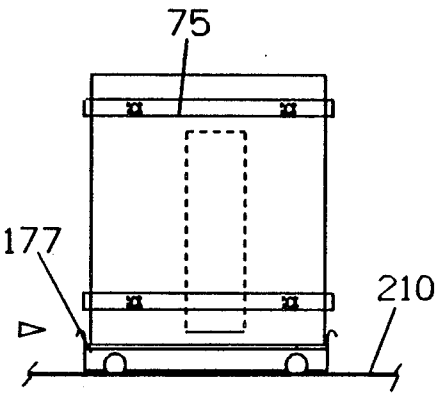
Figure 26:
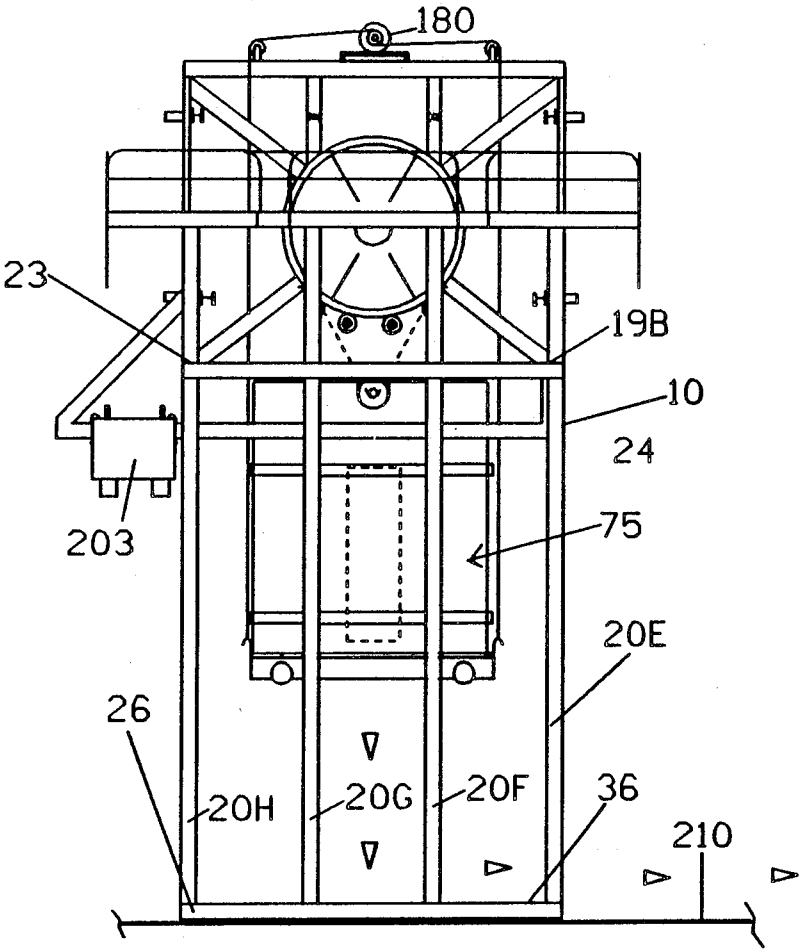

Referring now to FIG. 26, the mold 75 is being lowered by the hoisting system 180 until it reaches the rails 210 at which point it is moved away from molding machine 10. Referring now to FIG. 27, shows the mold 75 on a transporter 177.

Figure 28:
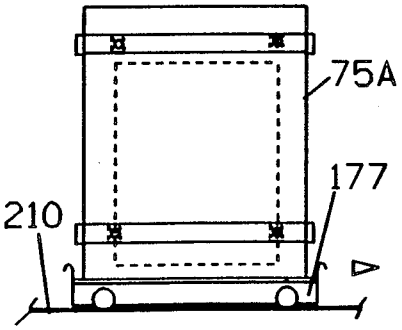

The new mold 75A is shown in FIG. 28 ready to be installed in the molding machine 10.

Figure 29:
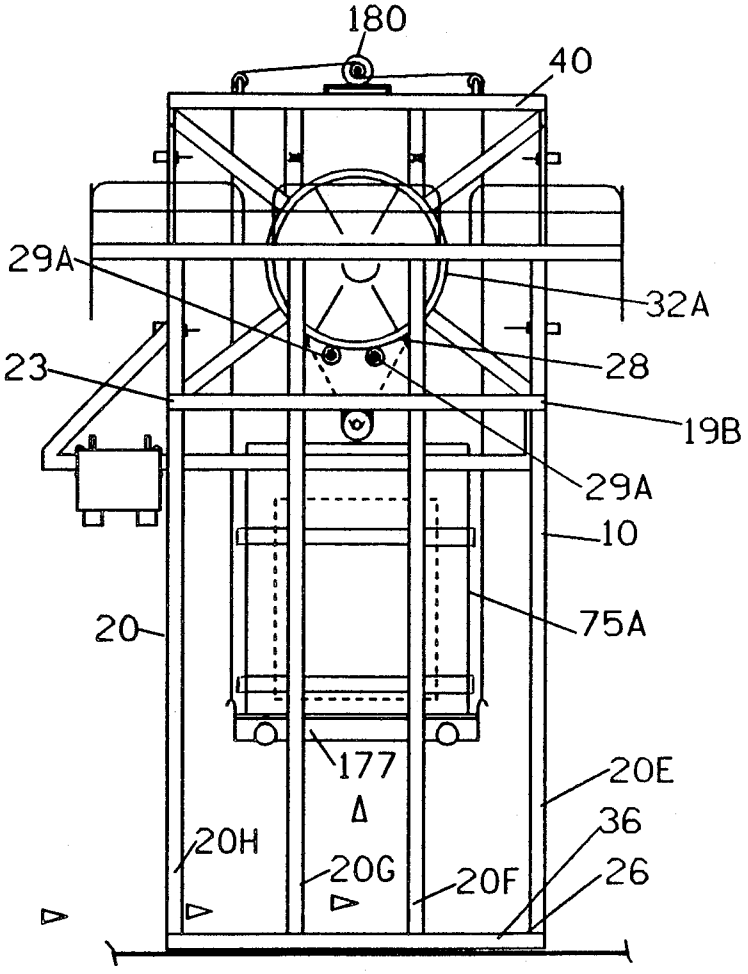

Referring now to FIG. 29, the new mold 75A is being lifted into the rotatable apparatus 40. Referring now to FIG. 30, the mold 75A is bolted to the rotatable apparatus 40, while the hoisting system 180 maintains the new mold 75A in position. FIG. 31 shows the transporter 177 with the mold-holder 219 being lowered by the hoisting system 180. FIG. 32 shows the transporter 177 and mold-holder 219 on the transporter 177.

Figure 33:
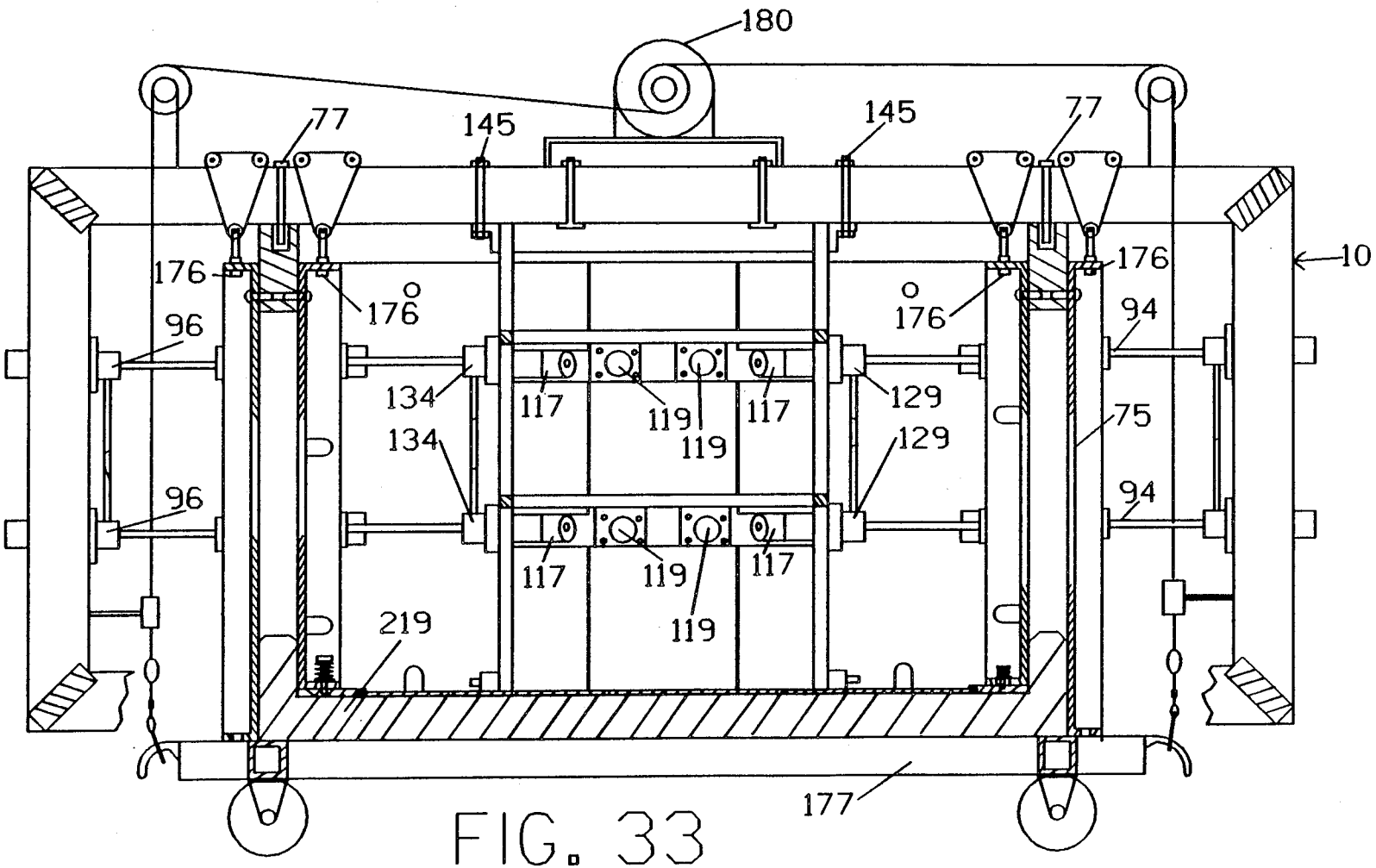
FIG. 33 illustrates how the mold is removed from the molding machine.

FIG. 33 shows the hoisting system 180 supporting the transporter 177 and the mold 75. The mold 75 may be removed by by unscrewing bolts 77 and 145 and unfastening all of the nuts 176 from all the overhead trolleys 88, 90, 92, 105, 107, 109, 111, 115, 125, 128 and 133, and by releasing exterior JACTUATORS 93, 94, 95 and 96.

Figure 34:
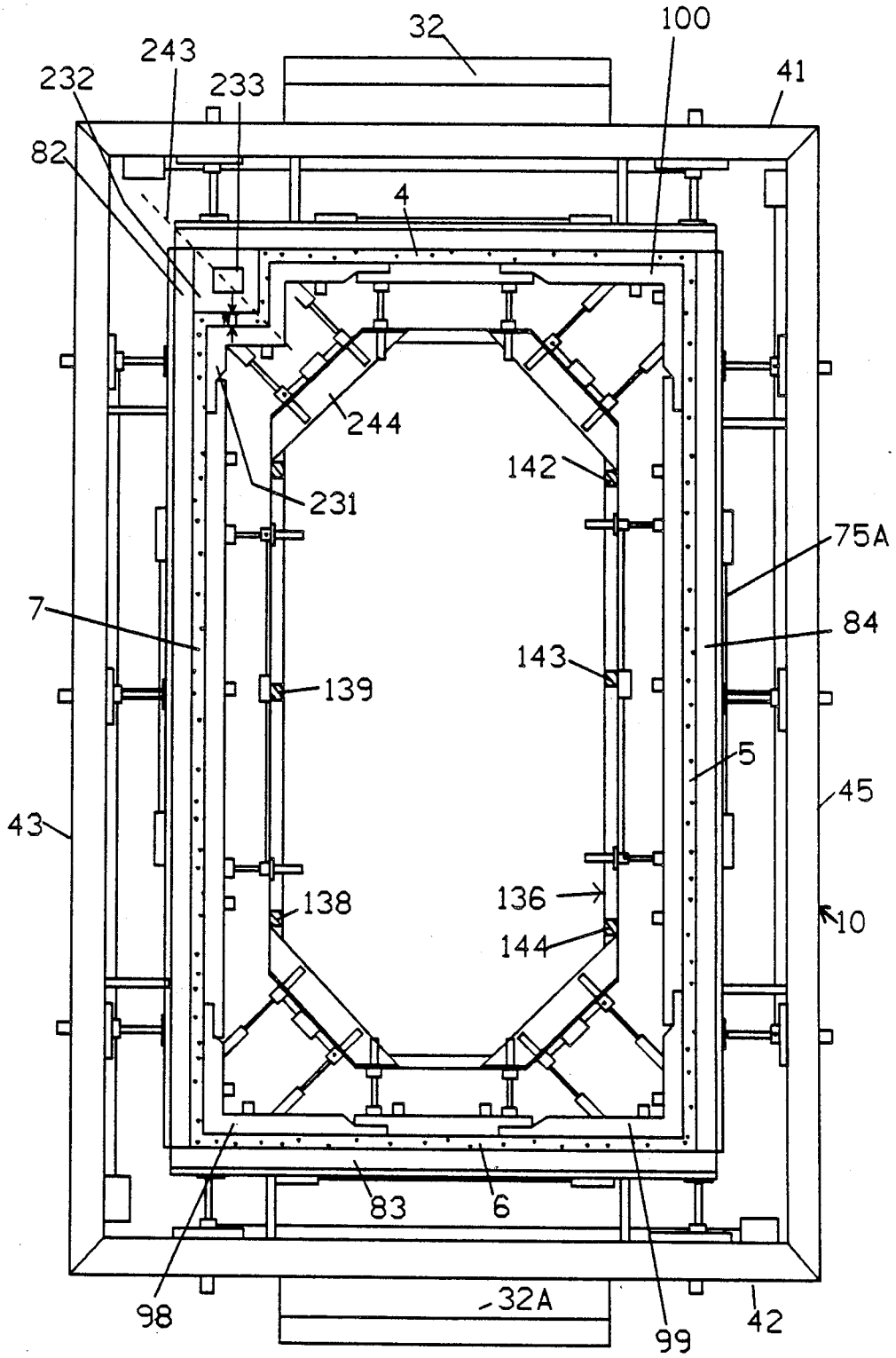
FIG. 34 shows a partial top view of another molding machine with the floor panel removed and disclosing details of the corner forming device and, in particular, the chase forming corner.
Figure 43:
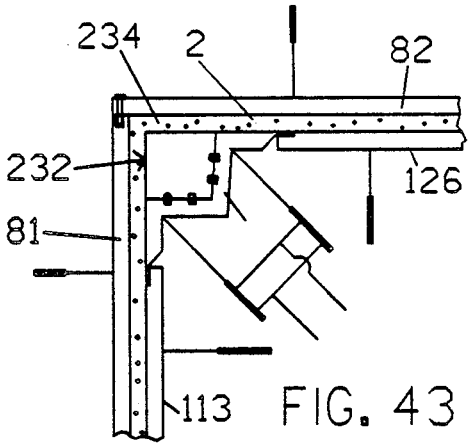
FIG. 43 shows a partial, fragmentary, cross-sectional view, similiar to FIG. 40, except that it shows a 90 degree corner
Figure 44:
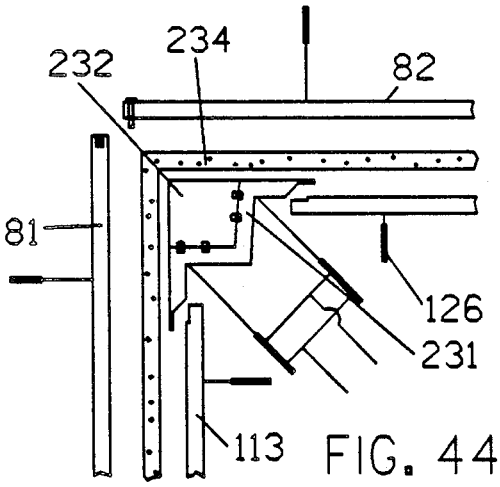
FIG. 44 shows a partial, fragmentary, cross-sectional view, similiar to FIG. 43, except that the mold is in a discharge position so as to release the product from the mold.
Figure 45:
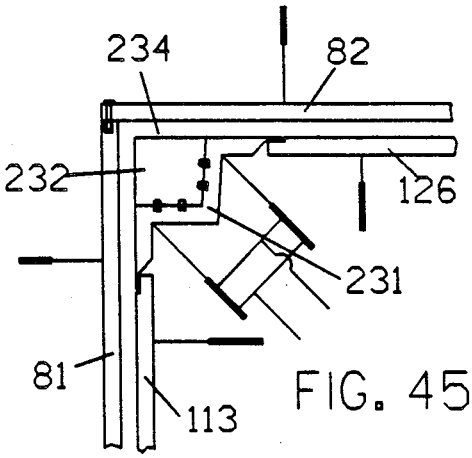
FIG. 45 shows a partial, fragmentary, cross-sectional plan view, similiar to FIG. 43, in a casting position ready to accept poured concrete between the exterior wall panels, interior wall panels and interior corner wall panels.

Referring now to FIG. 34, a cross-sectional view of the rotatable apparatus 40 and the mold 75A is shown therein. It should be noted that the cut is taken below the floor line 230 of the floor 3 to show a cross-sectional view of the vertical concrete walls 4, 5, 6 and 7. The mold 75A shown in FIG. 34 is similiar to the mold 75 of FIG. 2, except that the chase forming corner 231 differs from the interior corner-forming panels 97, 98, 99 and 100. The difference lies in the chase forming corner 231 and chase forming block-out 232 which can be moved from the exterior wall panel 82 to the chase forming corner 231. In other words, the chase forming block-out 232 may be moved along a diagonal path 243 from a chase forming position 233 as shown in FIGS. 34, 40, 41 and 42 to a non-forming chase position 234 as shown in FIGS. 43, 44 and 45. In FIG. 34, the chase forming corner 231 and the chase forming block-out 232 are separated by a wall-thickness "WT", which wall-thickness "WT" is of the same thickness as walls 5 and 6. The chase forming blockout 232 is bolted to exterior wall panel 82, but the top surface 235 of the chase forming blockout 232 is at the same elevation as the floor panel 147. The purpose of this arrangement may be seen in FIG. 36 wherein the top surface 235 of chase forming blockout 232 is at the same elevation as the floor panels 137 and 147A, but is below the exterior wall panels 81 and 82, so that concrete 1 may be poured into the cavity 80 to form the chase 236 with two vertical walls 237 and 238 that are integrated with vertical walls 4 and 5 of the room module 2. The reason that the chase forming block-out 232 is not at the same elevation as the chase forming corner 231 is that the chase forming corner 231 can move on a diagonal path 243 beneath floor panels 137 and 147A thereby permitting the chase-forming corner to be released.

The JACTUATORS 117 are so disposed on the base plate 241 in order that the chase forming corner 231 may be installed at one or more corners which, together with the chase forming block -out 232, may be used with the chase-forming corner 231 as mentioned hereinabove.

Figure 35:
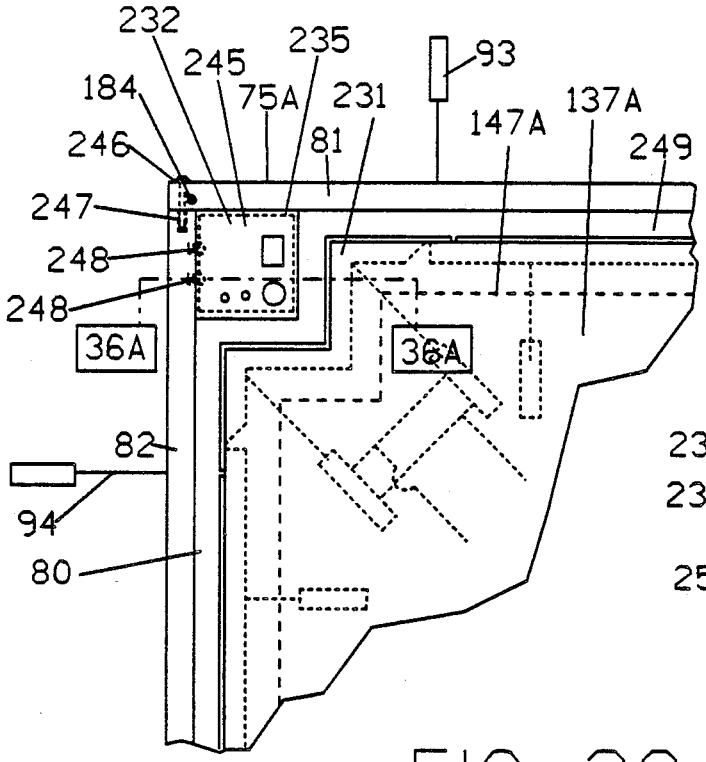
FIG. 35 shows a partial plan view of the floor panel and corner forming device at the same elevation so that when the concrete is poured, the concrete then covers the chase up to the floor level and permits the walls of the chase to be molded.

Referring now to FIG. 35, the mold 75A is shown in the casting position 120. Only corner 245 of the mold 75A is shown. The corner 245 includes exterior wall forming panels 81 and 82 which are aligned together by a pin 246 fixed in exterior wall-forming panel 81 and extending into exterior wall-forming panel 82 in a hole 247 thereof. The chase forming block-out 232 is fastened to the exterior wall-forming panel 82 by a series of bolts 248. The floor panel 147A is set around the chase forming 231 while the chase forming corner 231 extends slightly beyond the floor forming base 147A. The space 249 between the chase forming corner 231 and the chase forming block-out 232 and between the exterior wall-forming panel 81 and the interior wall-forming panel 113 and the exterior wall-forming panel 82 and the interior wall-forming panel 126 is filled by product's configration form 76A at the bottom of the mold 75A.

Figure 36A:
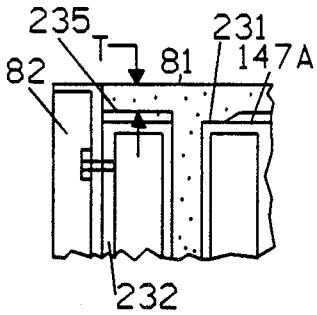
FIG. 36A shows a cross-sectional view of the chase of FIG. 35 filled with poured concrete.
Figure 36:
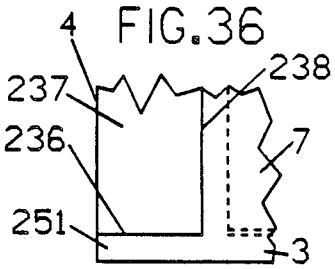
FIG. 36 shows a partial elevation view illustrating how the poured floor and chase are formed.
Figure 37:
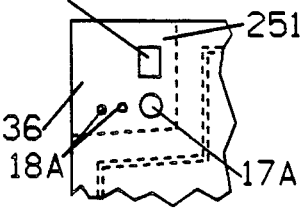
FIG. 37 illustrates a partial bottom view of the chase of FIG. 36.

Referring to FIG. 36, the chase 236 is shown as having been formed with vertical walls 237 and 238. FIG. 37 shows a bottom view of the same chase forming corner 231 with holes 16A, 17A and 18A. The advantage of forming chase forming corners 231 in the room module 2 is that the concrete chase 236 acts as a fire stop 251 between each floor (not shown) of the building (not shown).

Figure 38:
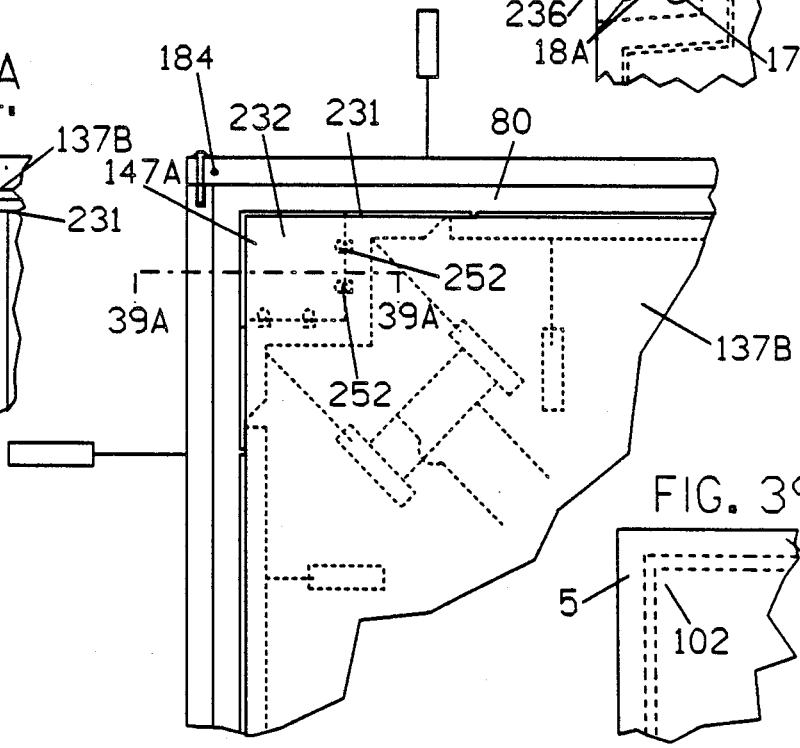
FIG. 38 shows a fragmentary, partial plan view disclosing how the chase has been eliminated by altering the corner forming device and placement of a new floor panel in the chase's place.

Referring now to FIG. 38, the mold 75A is shown in a casting position 120. The chase forming block-out 232 has been attached to the chase forming corner 231. In this position, the corner 102 is created. The chase forming block-out 232 is bolted to the chase forming corner 231 by a series of bolts 252.

Figure 39A:
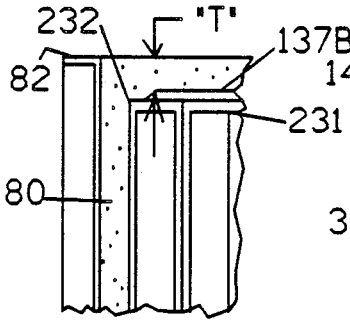
FIG. 39A shows a cross-sectional view of a typical wall and floor assembly without the chase.
Figure 39:
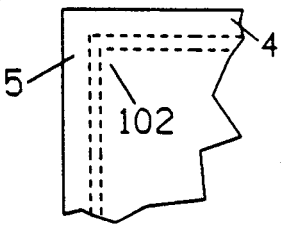
FIG. 39 is a partial bottom view of the room module without the chase.

Referring to FIG. 39A, a partial fragmentary cross-sectional view of the corner forming panel 231 and the chase forming block-out 232 working in unison beneath floor base 137A and 147A is seen. The floor panels 137A and 147A are beneath the exterior panels 81 and 82 by a distance "T".

Figure 40:
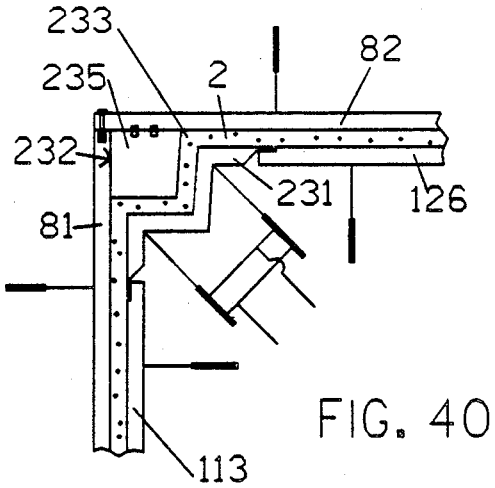
FIG. 40 shows a partial, fragmentary, cross-sectional plan view showing the chase filled with poured concrete.
Figure 41:
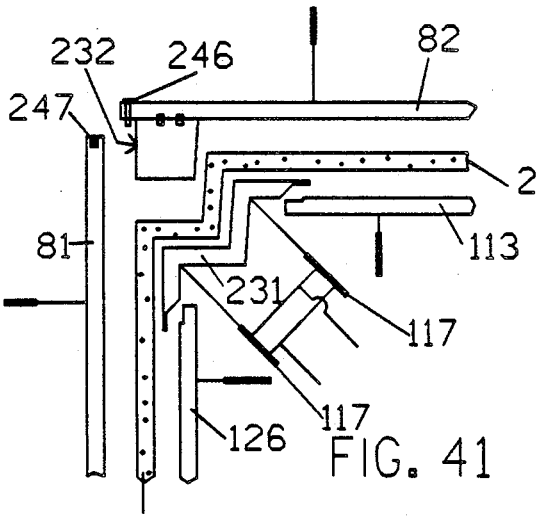
FIG. 41 shows a partial, fragmentary, cross-sectional plan view, similiar to FIG. 40, except that all the walls of the mold are shown in the discharge position so as to release the product from the mold.
Figure 42:
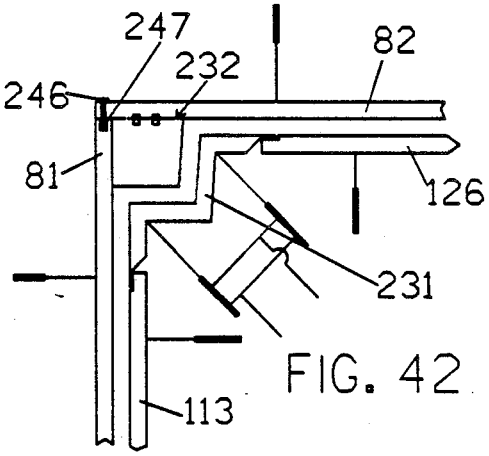
FIG. 42 shows a partial, fragmentary, cross-sectional view, similiar to FIG. 40, except that the mold is in the casting position, ready to accept another pouring of concrete.

Referring to FIGS. 40, 41, 42, there is shown a typical chase forming corner 231 which illustrates the sequence of operation from the casting position 120 to the discharge position 120A and then back again to the casting position 120. As may be observed in FIG. 41, the exterior wall-forming panel 81 is released from the exterior wall-forming panel 82 first by moving the pin 246 from the hole 247. Once wall 81 has been released from the casting position 120 to the discharge position 120A, then exterior wall-forming panel 82 is free to move into the discharge position 120. The interior wall-forming panels 113 and 126 are then withdrawn from the casting position 120 to the discharge position 120A to allow the corner forming panel 231 to also withdraw from the casting position 120 to the discharge position 120A. The sequence of operation of the corner forming panel 231 or the interior corner forming panels 97, 98, 99 and 100 all operate in the similiar manner just explained for corner forming panel 231. FIG. 42 shows the order in which the mold 75 is reassembled and placed in the casting position 120. The chase forming corner 231 is moved to the casting position 120 and thereafter interior wall-forming panels 113 and 121 are moved into the casting position 120. At the same time, exterior wall forming panel 82 is moved into the casting position 120 and then exterior wall forming panel 81 is also moved into the casting position 120 and locked therein by pin 246 into hole 247.

Referring now to FIGS. 43, 44 and 45, we see the same illustration as shown in FIGS. 40, 41 and 42, except that the chase forming block-out 232 is now assembled to chase forming corner 231 and as can be seen by the views in FIGS. 43, 44 and 45, the concrete chase 236 is omitted in these figures.

Figure 46:
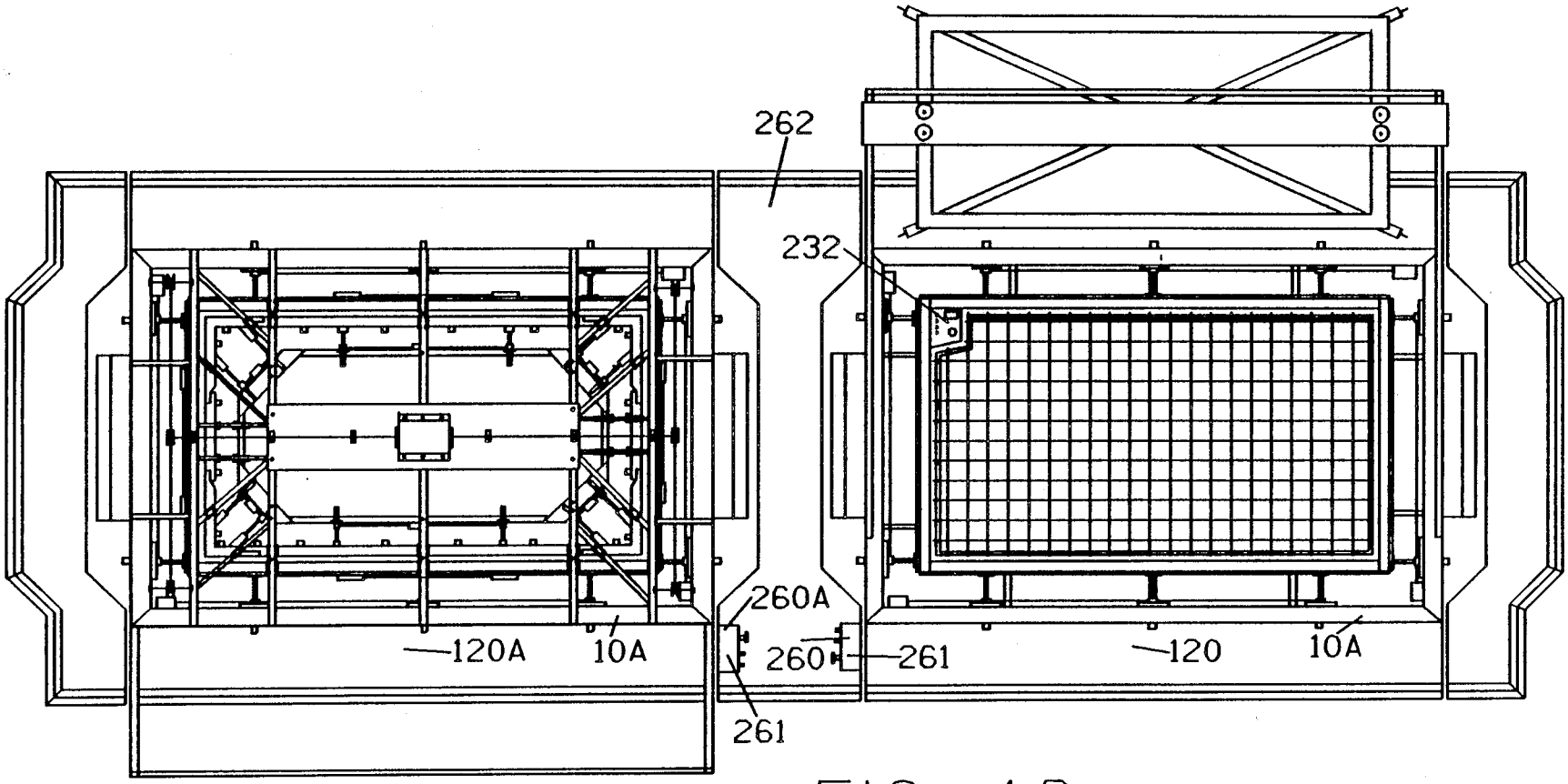
FIG. 46 illustrates a plan top view of the molds contained within two molding machines mounted in tandem with each other, the right hand mold is in the casting position and the left hand mold is in the discharge position.
Figure 47:
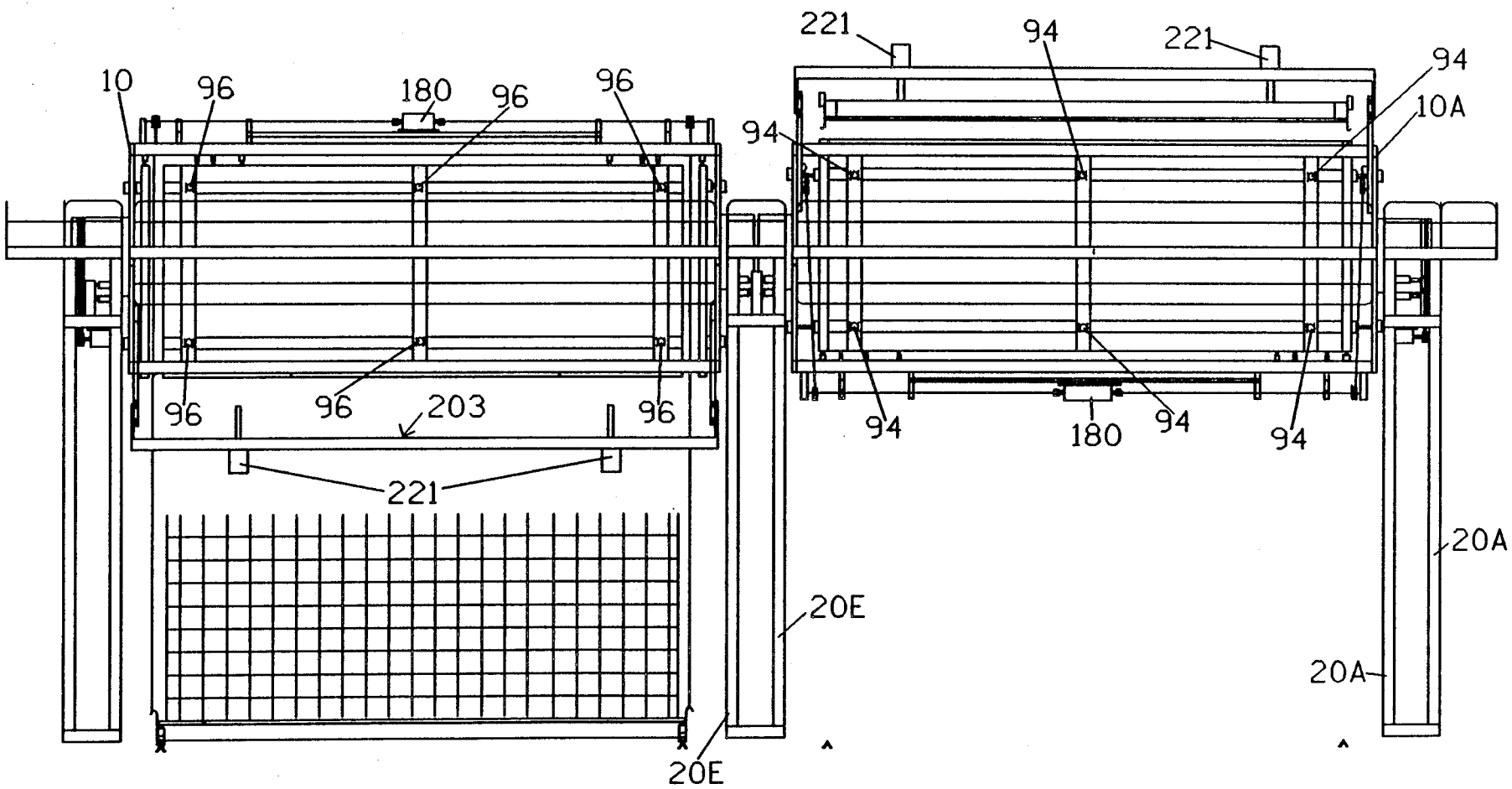
FIG. 47 illustrates a front elevation of the tandem molding machines shown in FIG. 46.

FIGS. 46 and 47 show two molding machines 10, 10A. Molding machine 10 is shown in the casting position 120 while the machine 10A is shown in the discharge position 120A. The control panel 260 includes all of the controls 261 for the molding machine machine 10, while control panel 260A includes all of the controls 261A for the molding machine 10A. Thus, a person standing on platform 262 can control either one of the molding machines 10, 10A. The molding machines 10, 10A may include chase forming corners 231 and chase forming block-out 232 as shown in the molding machine 10, or indeed if it is desired, to include the interior corner forming panels 97, 98, 99 and 100. Thus, it may be seen that the molding machines 10, 10A are diversified in that the various room modules 2 may be built with molding machines 10, 10A.

Figure 48:
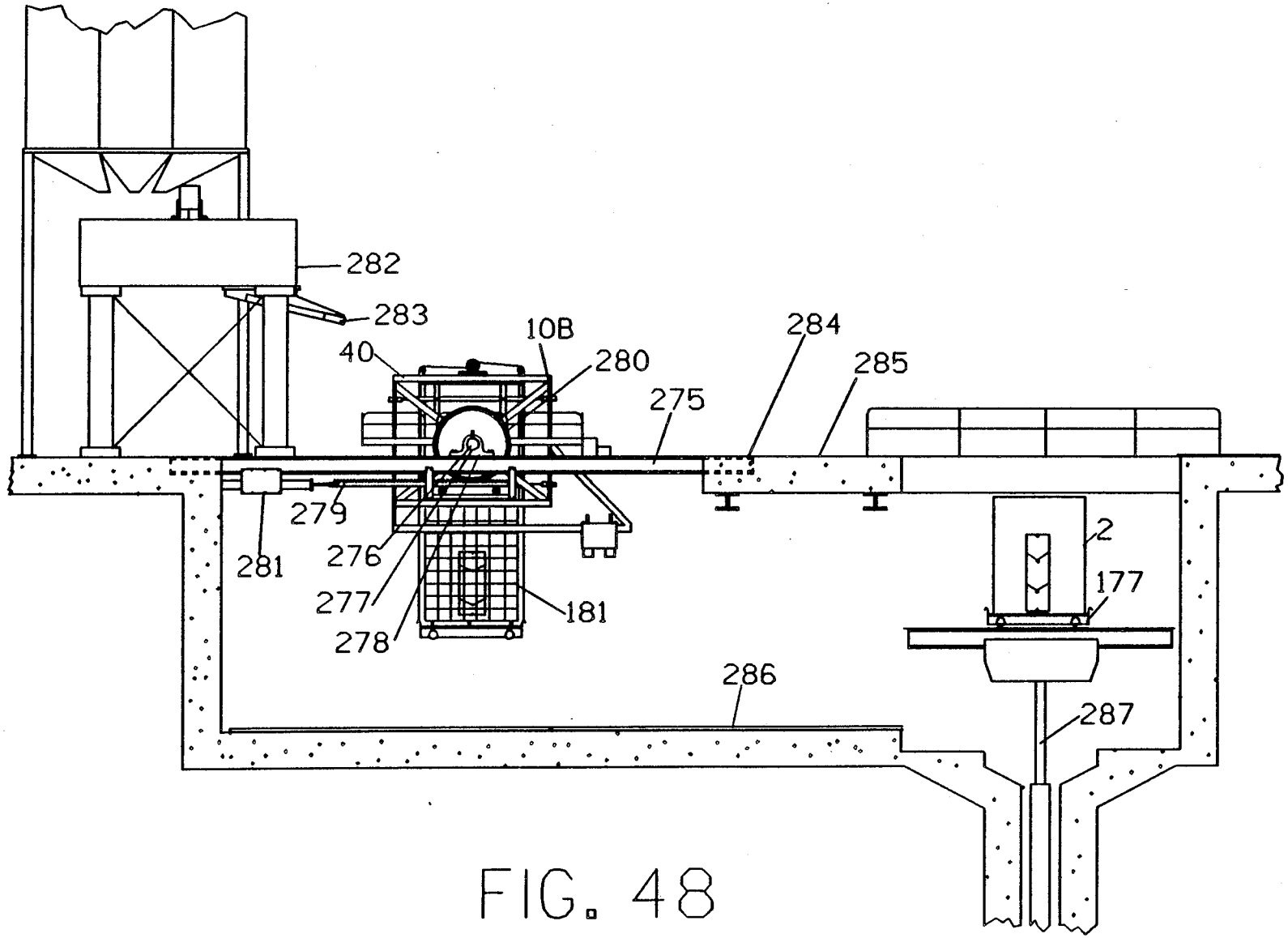
FIG. 48 illustrates a side elevation of another molding machine.
Figure 49:
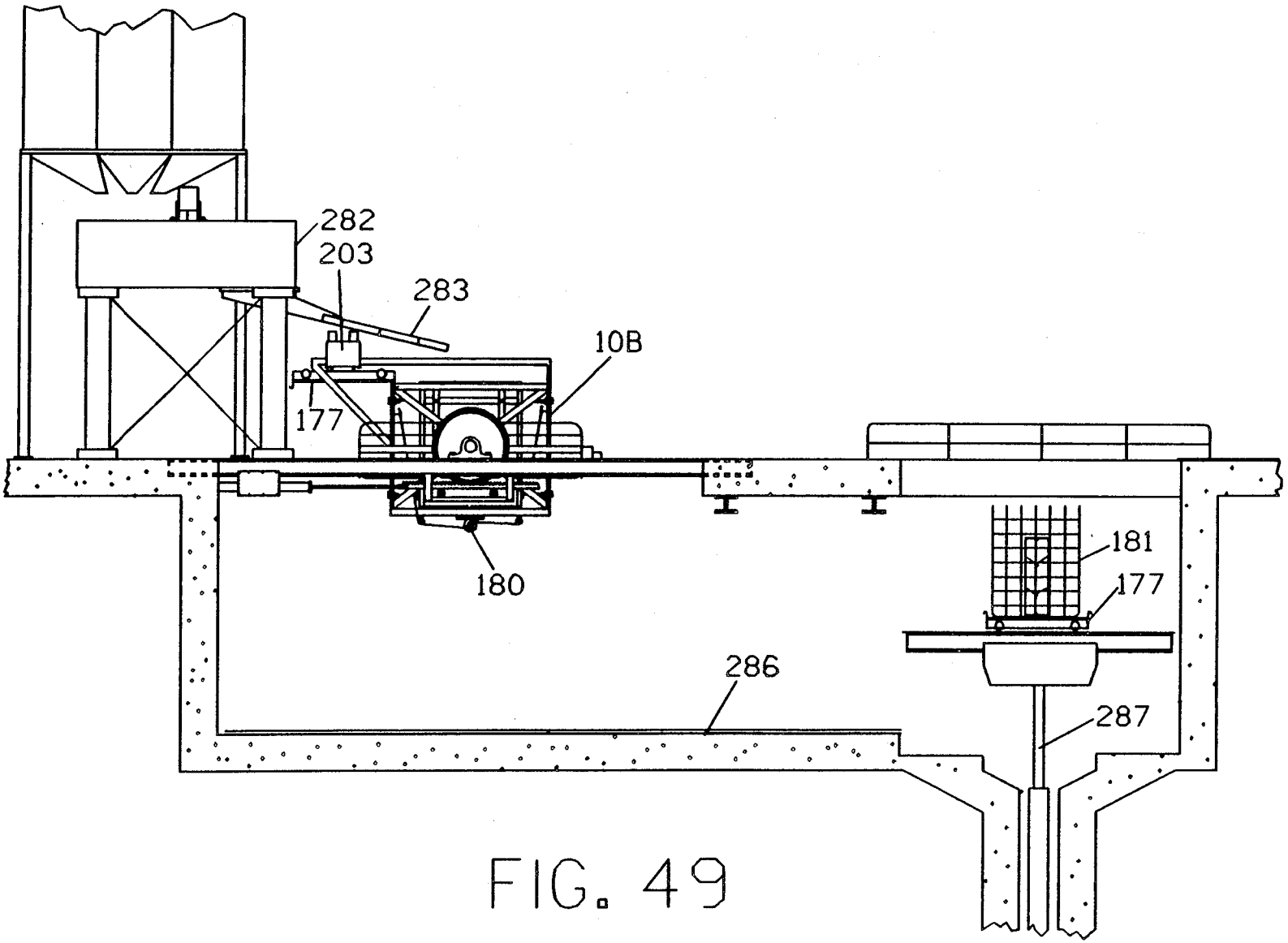
FIG. 49 illustrates another side view of the molding machine which is shown in FIG. 48.
Figure 50:
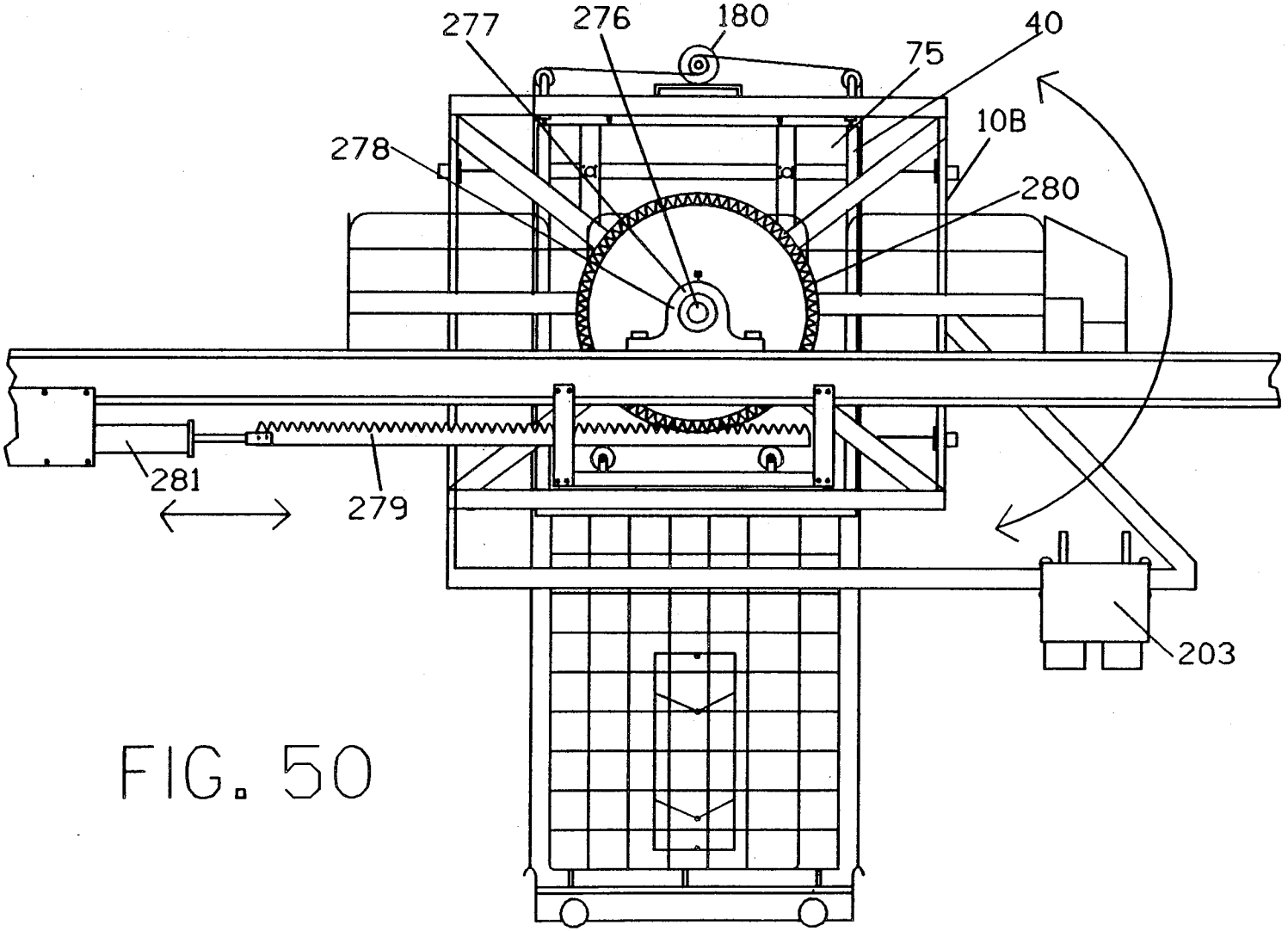
FIG. 50 illustrates another side view of the molding machine which is shown in FIG. 49.

FIGS. 48, 49 and 50 illustrate another embodiment of the invention, that is instead of having a stationary support system 20 with vertical paired columns 20A, 20B, 20C, 20D on one side of the machine and vertical paired columns 20E, 20F, 20G, 20H, and on the other side we have a pair of horizontal beams 275 supporting the molding machine 10B. The molding machine 10B is fixed on a pair of shafts 276 supported on two main bearings 277 housed in journal boxes 278. The rotatable apparatus 40 is rotated 180 degrees between the casting position 120 shown in FIG. 49 and the discharge position 120A shown in FIG. 48 by a hydraulically operated rack 279 and pinion 280. The rack 279 is connected to a hydraulic cylinder 281. Shown at 282 is a means for pre-mixing concrete 1 therein and pouring the mixed concrete into the molding machine 10B by the chute 283. It may now be seen that room modules 2 are cast by the molding machine 10B then rotated 180 degrees to the discharge position 120A as shown in FIGURES 49 and 50.

FIGS. 48 and 49 show how a typical factory 284 may be laid out with the molding machine 10B on one floor 285 and room modules 2 may be discharged from the molding machine 10B and then placed on the rails 286. From the rails 286 the room module 2 and transporter 177 may be lifted by a hydraulic elevator 287 to the original factory 284 of the molding machine 10B. FIG. 49 shows the wire cage 181 on a transporter 177 being lowered by the hydraulic elevator 287. The wire cage 181 and transporter 177 will be rolled onto the track 286 where the wire cage 181 and transporter 177 both await their turns in the molding machine 10B. In the meantime, the molding machine 10B has just been filled with a load of pre-mixed concrete 1. The pre-mixed concrete 1 is then cured. Referring now to FIG. 50, the hoisting system 180 has cart-hooks 196 which hook onto transporter hooks 197 in order to lift the transporter and wire cage 181 into the mold 75. The molding machine 10B operates in the same manner as the molding machines 10 and 10A of FIGS. 1 and 46.

Figure 51:
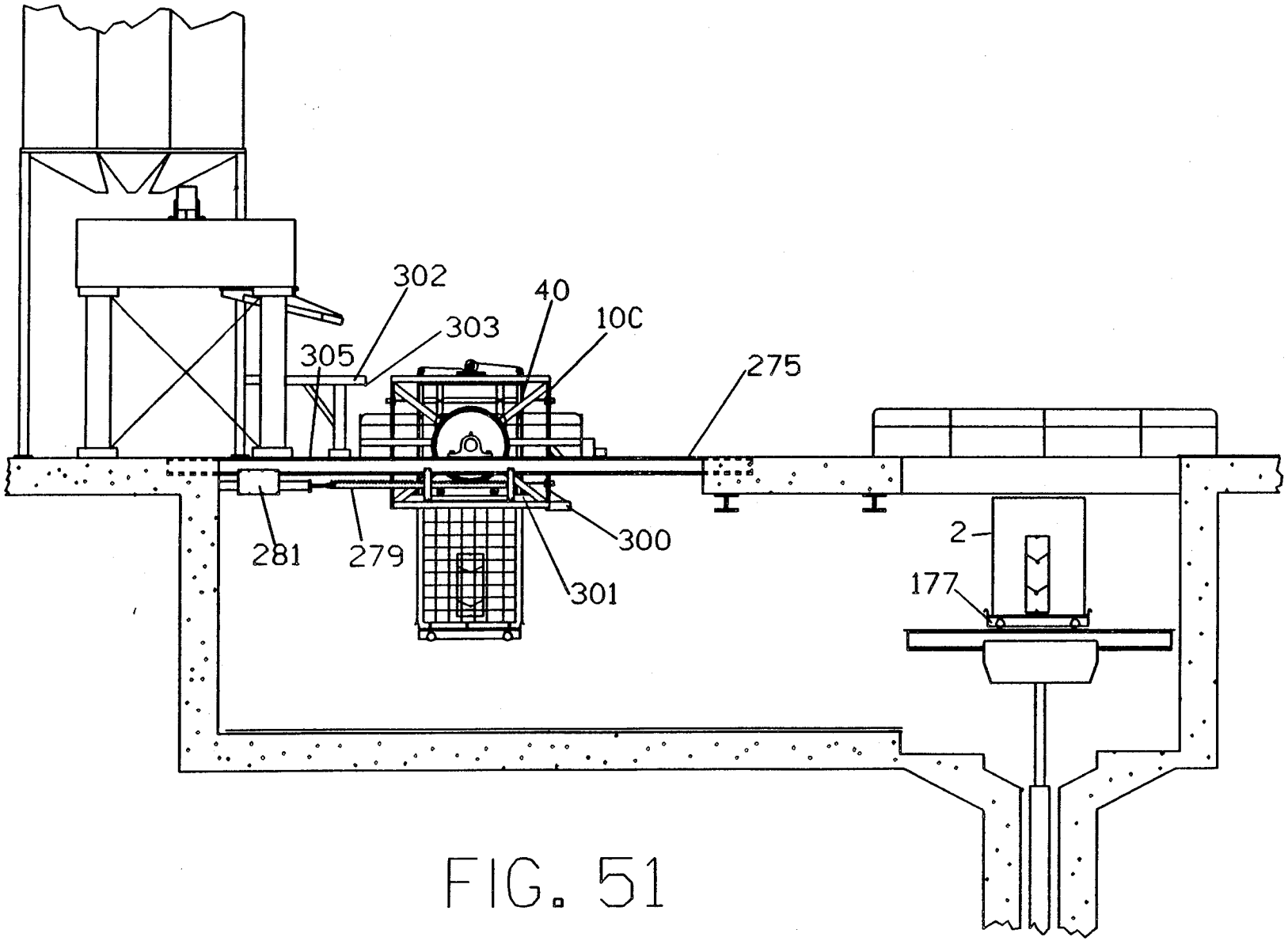
FIG. 51 shows another embodiment of the invention.
Figure 52:
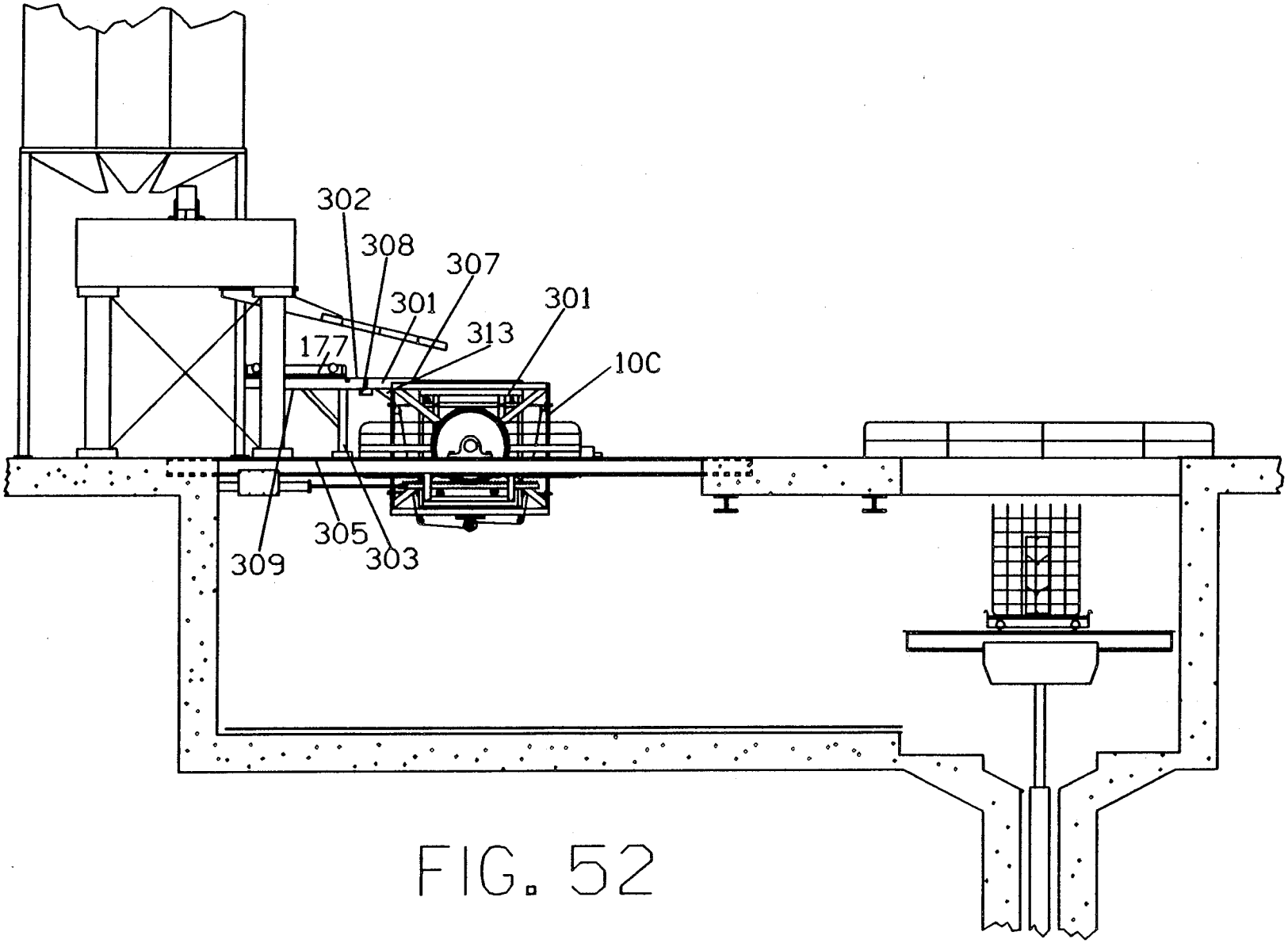
FIG. 52 is another view of the molding machine shown in FIG. 51.
Figure 53:
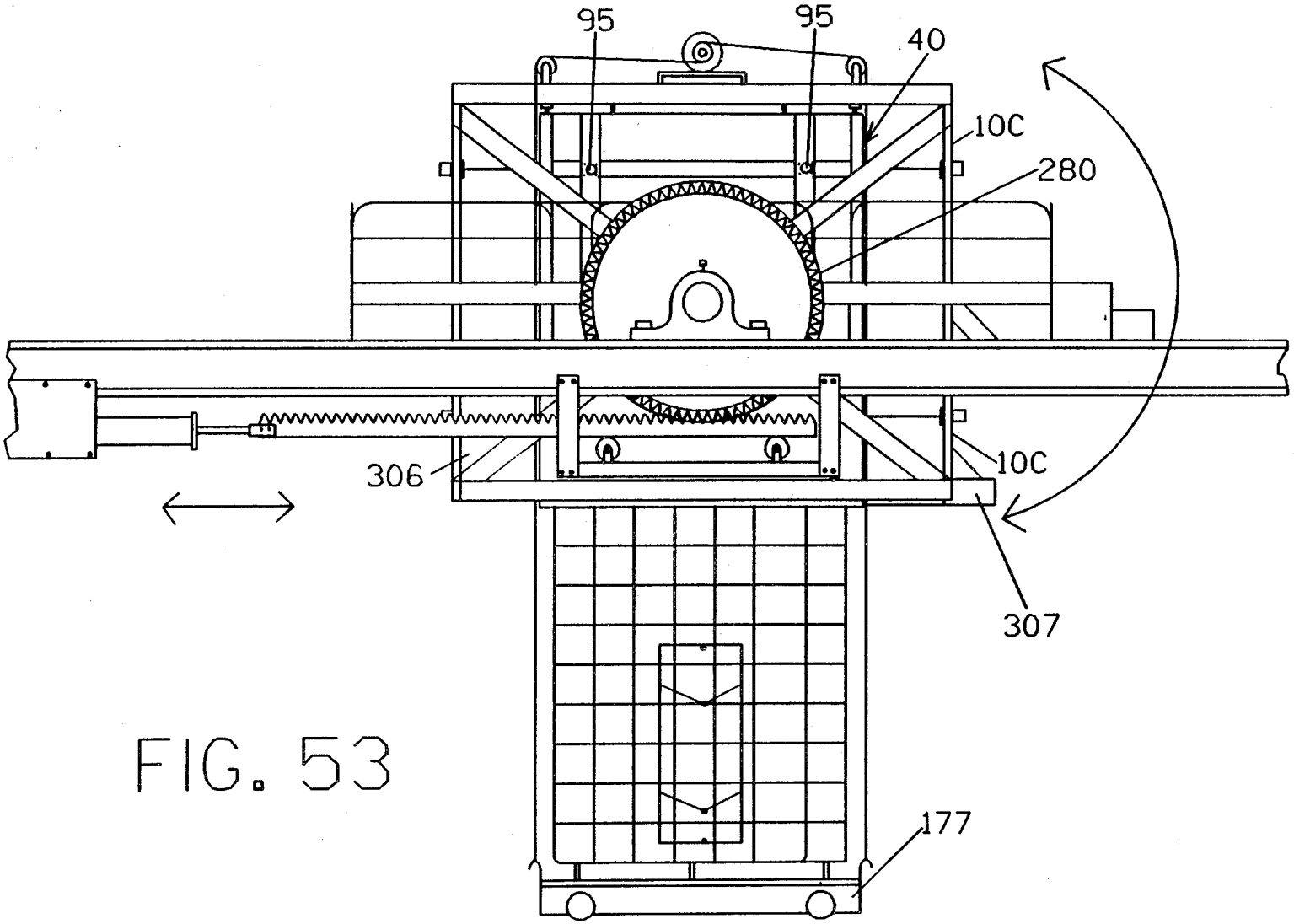
FIG. 53 is a partially enlarged side view of the molding machine shown in FIG. 51 and FIG. 52.
Figure 54:
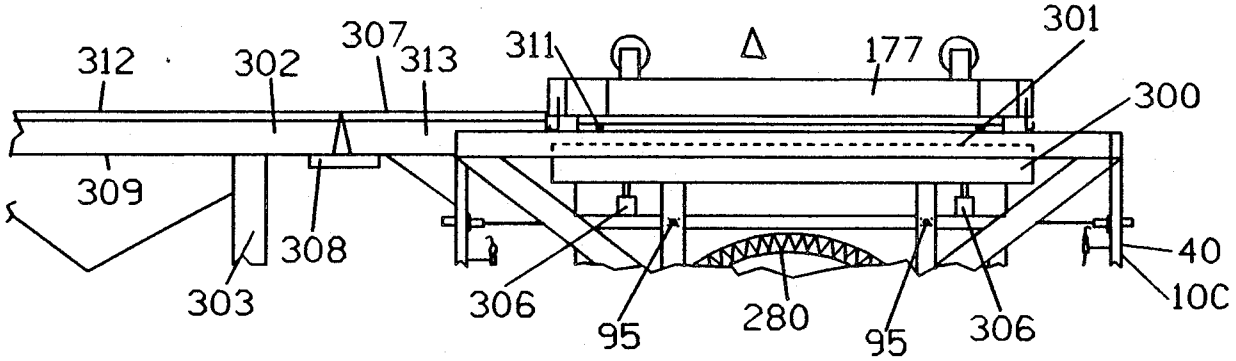
FIGS. 54, 55, and 56 show the operation of the transporter being lifted to the same elevation of the discharge track for storage thereon.
Figure 55:
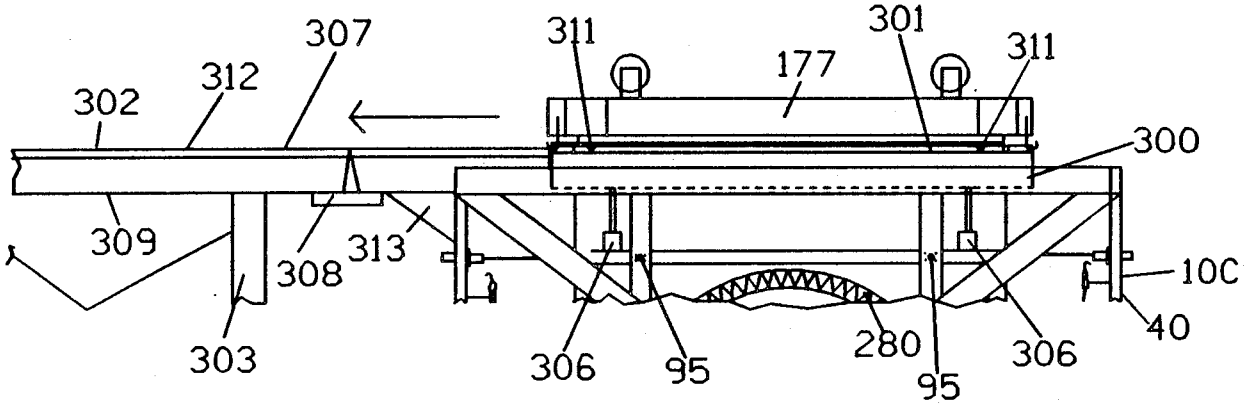
Figure 56:
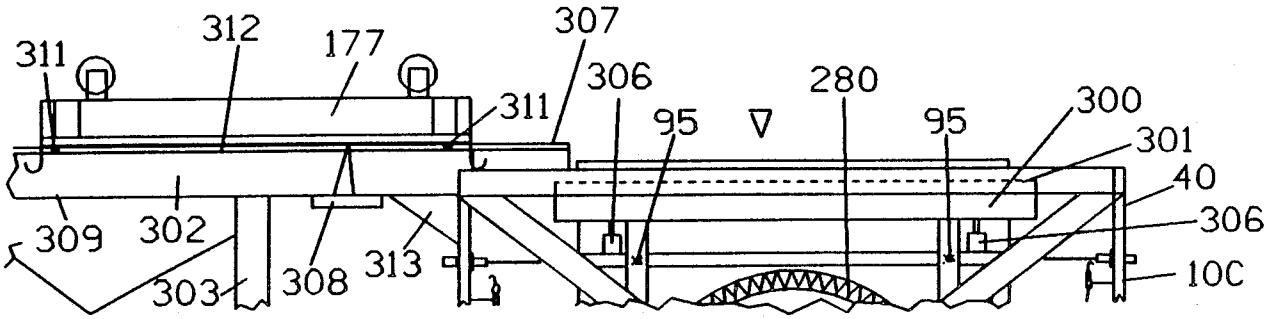

Referring now to FIGS. 51, 52, 53, 54 and 56, there is now shown another embodiment of the molding machine 10C. The molding machine 10C differs from molding machine 10, shown in FIG. 1, and the molding machines 10A, 10B, shown in FIG. 48, in the respect that the molding machine 10C utilizes a different transporter means 300 for storing of the transporter 177 when the mold 75 is in the casting position 120. As may be seen in FIGS. 51 and 52, the molding machine 10C utilizes a transporter means 300 for storing the transporter 177 when the mold 75 is in the casting position 120. The transporting means 300 comprises a moveable pair of rails 301 which lifts the transporter 177 when the molding machine 10C is in the casting position as shown in FIGS. 54, 55 and 56. The transporter 177 must of course be in the casting position 120. When in this position, the transporter 177 is lifted by the pair of rails 301 to the same height as the platform 302. The platform 302 is supported on four pedestals 303. The platform 302 as may be seen in FIG. 51, is not part of the molding machine 10C, but rather is fastened to the floor 305 and the pair of horizontal beams 275.

Referring again to FIGS. 54, 55 and 56, a transport means 300 includes air or hydraulic cylinders 306 which by means of a sensing signal (not shown) raises or lowers the pair of rails 301. When the hydraulic cylinders 306 raise the rails 301 with the transporter 177 thereon to the level of the spur rails 307 of the molding machine 10C, the spur rails 307 are fixed to a support member 313 which is mounted on the rotatable apparatus 40, and connects the platform rails 312 to the rails 301 of the molding machine 10C. A stop member 308 welded to the bottom side 309 of the platform 302 serves as a stop for the support 313 and spur rail 307 which is connected to the rotatable apparatus 40. The stop member 308 is fixed at the bottom of stationary platform 302. Because rotatable apparatus 40 rotates in a counterclockwise direction, spur rail 307 will come to a stop at the stop member 308, thus making rails 301, 307 and 312 in alignment with each other.

The molding machine 10C in all other respects is the same as the molding machines 10, 10A and 10B and, therefore, reference should be made to the other drawings herein for the operation of the molding machine 10C.

Figure 59:
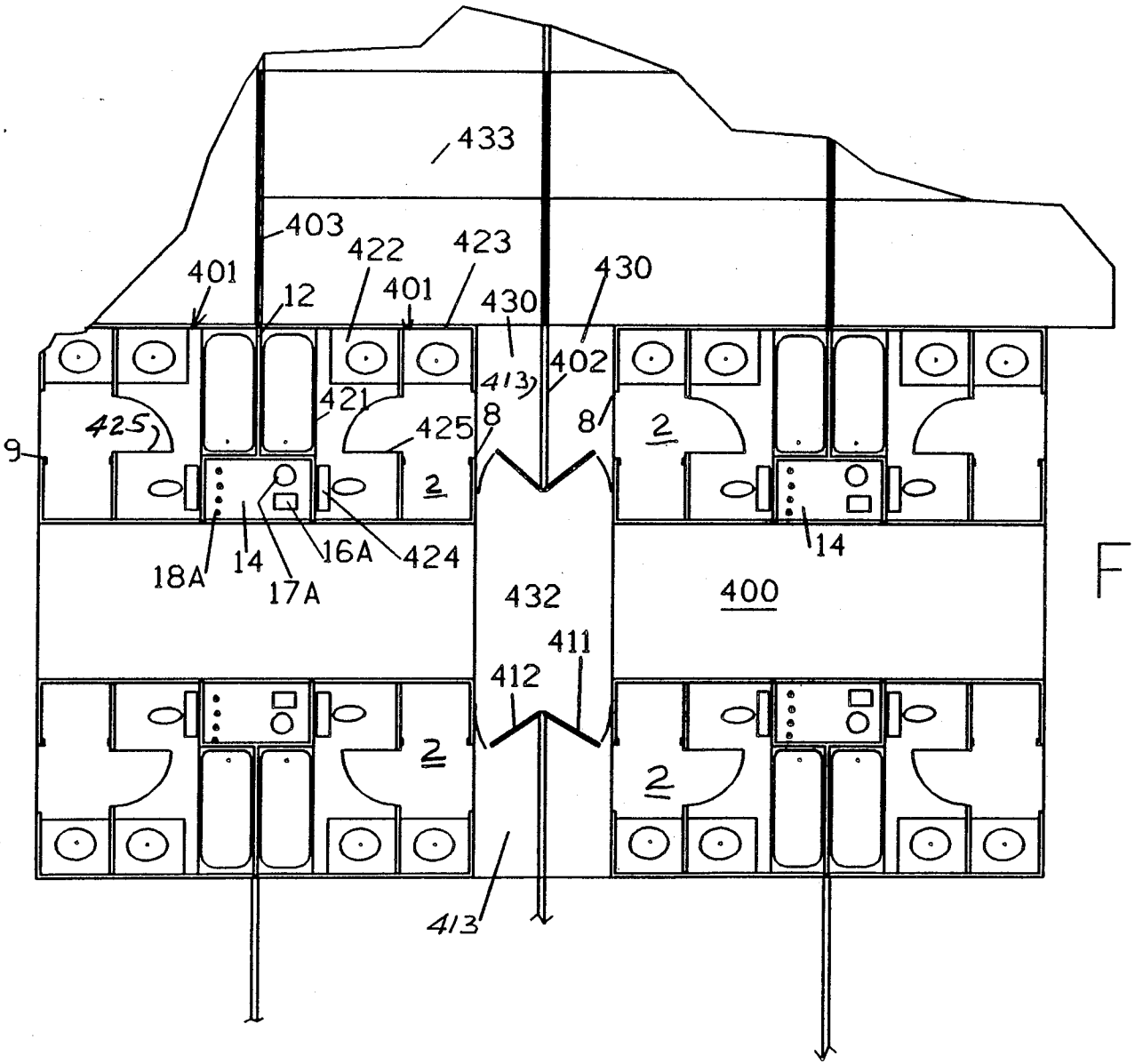
FIG. 59 is a plan view of a hotel utilizing the products.

Referring to FIGS. 57, 58 and 59, we see the room module 2 being used in the construction of a motel or hotel or apartment or hospital or nursing facility or extended care unit or housing or office building or the like 400. The room module 2 is furnished with two bathrooms 401 and 401A. The room module 2 is the building core of the motel, hotel, etc.. Wall panels 402, 403, hallway floor/ceiling panels 404, floor/ceiling panels 405, and room/floor/ceiling panels 406 are of a given thickness so that the topside of the panels 406 act as the floor and the bottom side as the ceiling to the room below it.

The room module 2 may be stacked one on top of the other, in which case the floor 3 of the room module 2 acts as a fire stop between room modules 2. Each room module 2, when completed, has a false ceiling (not shown) above which are installed heating, ventilating, air conditioning, mechanical, electrical and sprinkler systems (not shown), all of which are gathered into the chase area 14 and brought down to the basement (not shown) of the building (not shown) or to the top of the building (not shown). The advantage is that the aforesaid utility devices may be installed at the factory before the room module is shipped to the building site.

For the above purpose, the room module includes the chase area 14 and includes a rectangular opening 16A, a round opening 17A and small round opening 18A.

In the construction of the hotel 400, the vertical walls 402, 403 and 407 are first placed in the area as shown in FIGURES 58 and 59. A lintel 409 is placed across the door units 411, 412. The wall unit 402 is longer than the wall unit 403, since the wall unit 402 extends into the area 413 between the room modules 2. In a similiar manner, all of the wall units 402, 403 are placed in the hotel 400, as shown in FIGS. 58 and 59. The ceiling panels 404, 405 and 406 are then assembled around the room modules 2. The tabs 415 of the ceiling panel 404 and the tabs 416 of the ceiling panel 405 are used for placement with the room modules 2, that is the tabs 415, 416 are placed between room modules 2.

In the construction of the hotel 400, the bathrooms 401 and 401A include diametrically opposite doorways 8, 9. The modified "Y" partition 12 divides the room module 2 into two bathrooms 401 and 401A. Each bathroom 401 and 401A includes a tub 421, and sinks 422, 423 and a water closet 424. Doors 425 and 426 give privacy to the bathroom 401 and 401A. Interposed between the bathroom 401A and the wall panel 402 is a hallway 430 through which access from the hallway 432 and the room 433 may be had.

Figure 60:
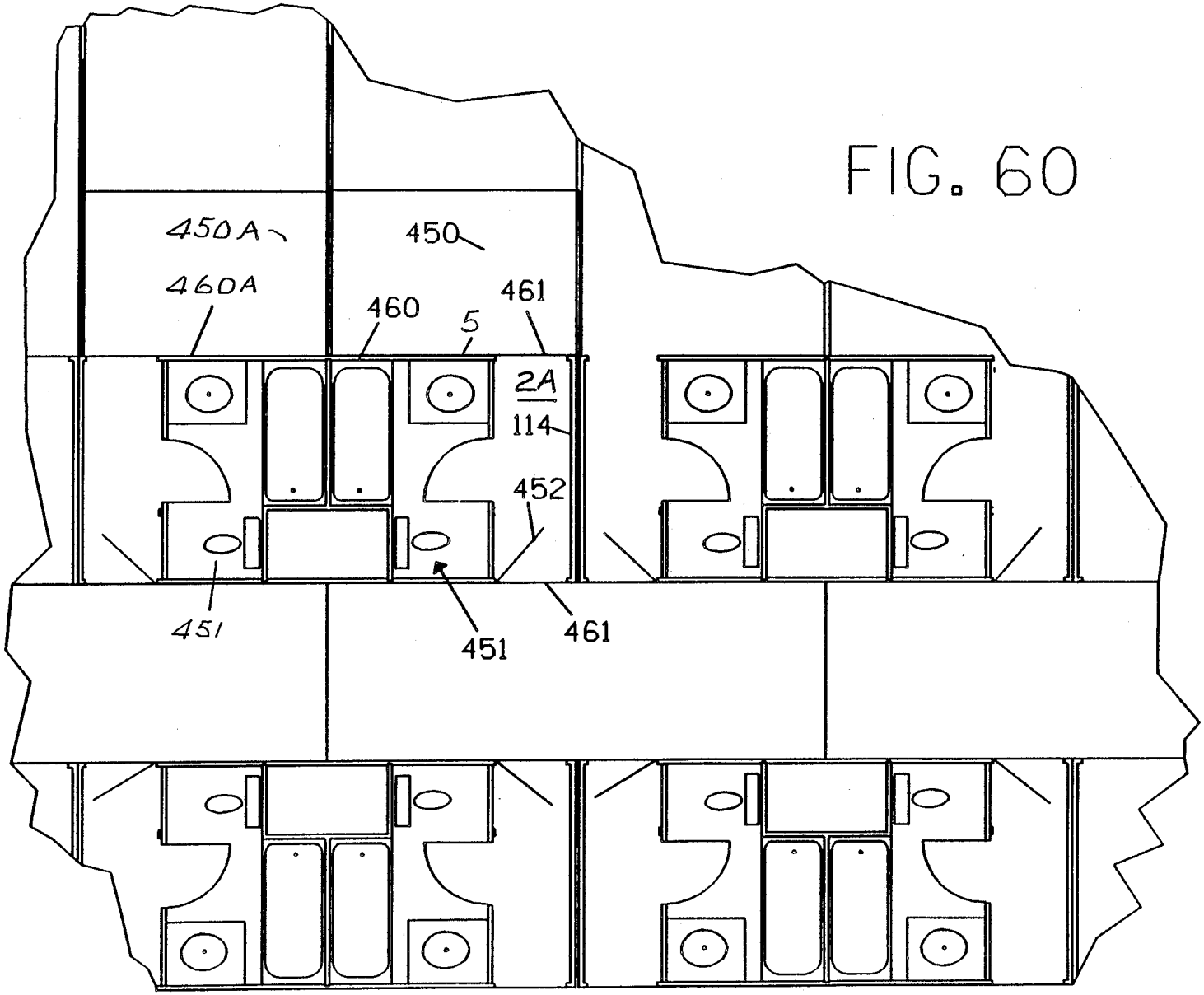
FIG. 60 is another plan view of a building structure utilizing the product.

Referring to FIG. 60, a smaller room 450 may be had with room module 2. Since the hallway 430 has been eliminated, and access to the room 450 is made through a door 452 and doorways 461 which are molded in the room module 2. Thus, the room module 2 is further modified to make a room module 2A. The room module 2A is still the same size, however, the doorways 461 are now located on the long side walls 5 and 7, to give bathrooms smaller than bathrooms 401 and 401A. The room module 2A now has doorways 461 through which access may be made to room 450 through hallways 114. Room module 2A includes 2 bathrooms 451 and 451A. Wall 5 of the room module 2A is divided into walls 460 and 460A for rooms 450 and 450A, respectively.

Having thus described the invention, it will be evident that other modifications and improvements may be made by one skilled in the art which would come within the scope of the annexed claims.

What is claimed is:

1. A molding machine for casting a concrete product comprising:

(a) a stationary support system;

(b) a pair of bearings fixed on said stationary support system on an axis of rotation;

(c) a rotatable apparatus interposed between said pair of bearings and having an open apparatus top rotatable thereon at least 180 degrees between a casting position and a discharge position about said axis of rotation;

(i) said rotatable apparatus having an apparatus bottom diametrically opposed to said open apparatus top;

(d) rotational means for rotating said rotatable apparatus about said axis of rotation;

(e) a mold having a mold bottom and a mold open top;

(i) said mold having a configuration form having the shape of a cross-section of the product mounted to said bottom of said rotatable apparatus;

(ii) said apparatus further including exterior wall-forming panels of a first height, and interior wall-forming panels and interior corner-forming panels having a second height shorter than said first height of said exterior wall-forming panels;

(iii) said mold having means for moving said exterior wall-forming panels, said interior wall-forming panels, and said interior corner-forming panels in contact with said configuration form and away from said configuration form;

(iv) said mold having a floor panel resting in cooperative relationship on said interior wall-forming panels and said interior corner-forming panels;

(f) a transporter;

(g) hoisting means fixed to said bottom of said rotatable apparatus and cooperating with said transporter for lifting and locking said transporter to said open top of said mold for rotation therewith; and (h) storage means for storing said transporter off said mold when said apparatus is disposed in said casting position.

2. The molding machine defined in claim 1 wherein said configuration form defines the spacing between the mold panels when in contact therewith.

3. The invention defined in claim 1 wherein said means for moving said exterior wall-forming panels, said interior wallforming panels, and said interior corner forming panels include trolleys to which said panels are respectively fastened, said trolleys being aligned to each other in a plane.

4. The invention defined in claim 1 wherein said hoisting means includes pins which are moveable into and out of locating holes in said transporter.

5. The invention defined in claim 1 wherein said hoisting means raises and lowers said transporter to and from said mold.

6. The invention defined in claim 1 wherein said transporter has locating bushings on said transporter which cooperate with said mold for locking said transporter to said mold, and a platform disposed at a level above said busings.

7. A molding machine for casting a concrete product comprising:

(a) a stationary support system;

(b) a pair of bearings fixed on said stationary support system on an axis of rotation;

(c) a rotatable apparatus interposed between said pair of bearings and having an open apparatus top rotatable thereon at least 180 degrees between a casting position and a discharge position about said axis of rotation;

(i) said rotatable apparatus having an apparatus bottom diametrically opposed to said open apparatus top;

(d) rotational means for rotating said rotatable apparatus about said axis of rotation;

(e) a mold having a mold bottom and a mold open top;

(i) said mold having a configuration form having the shape of a cross-section of the product mounted to said bottom of said rotatable apparatus;

(ii) said apparatus further including exterior wall-forming panels of a first height, and interior wall-forming panels and interior corner-forming panels having a second height shorter than said first height of said exterior wall-forming panels;

(iii) said interior corner-forming panels each having a block-out device removably secured to said corner-forming panels so that concrete may be cast therein in order to form a rectangular corner thereat;

(iv) said mold having means for moving said exterior wallforming panels, said interior wall-forming panels, and said interior corner-forming panels with said blockout device in contact with said configuration form and away from said configuration form;

(v) said mold having a floor panel resting in cooperative relationship on said interior wall-forming panels and said interior corner-forming panels with said block-out device;

(f) a transporter;

(g) hoisting means fixed to said bottom of said rotatable apparatus and cooperating with said transporter for lifting and locking said transporter to said open top of said mold for rotation therewith; and (h) storage means for storing said transporter off said mold when said mold is disposed in said casting position.

8. The invention defined in claim 7 wherein said means for moving said corner-forming panels moves said corner-forming panels along a path defined as a diagonal between a pair of adjacent interior wall-forming panels.

9. The invention defined in claim 7 wherein said configuration form defines the spacing between the mold panels when in contact therewith.

10. The invention defined in claim 7 wherein said means for moving said exterior wall-forming panels, said interior wall-forming panels, and said interior corner forming panels include trolleys to which said panels are respectively fastened, said trolleys being and aligned to each other in a plane;

11. The invention defined in claim 7 wherein said hoisting means includes pins which are moveable into and out of locating holes in said transporter.

12. The invention defined in claim 7 wherein said hoisting means raises and lowers said transporter to and from said mold.

13. The invention defined in claim 7 wherein said transporter has locating bushings on said transporter which cooperate with said mold for locking said transporter to said mold, and a platform disposed at a level above said bushings.

* * * * *